US008757534B2

(12) United States Patent
Lehrieder et al.

(10) Patent No.: US 8,757,534 B2
(45) Date of Patent: Jun. 24, 2014

(54) REEL CHANGER HAVING A SECURING MEANS FOR A SAFETY AREA

(75) Inventors: Erwin Paul Josef Lehrieder, Gaukonigshofen (DE); Klaus Karl Muller, Triefenstein-OT Trennfeld (DE); Josef Herbert Olbort, Mainbernheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 13/522,383

(22) PCT Filed: Oct. 1, 2010

(86) PCT No.: PCT/EP2010/064665

§ 371 (c)(1),
(2), (4) Date: Jul. 16, 2012

(87) PCT Pub. No.: WO2011/088905

PCT Pub. Date: Jul. 28, 2011

(65) Prior Publication Data

US 2013/0008996 A1 Jan. 10, 2013

(30) Foreign Application Priority Data

Jan. 19, 2010 (DE) ..... 10 2010 001 014

(51) Int. Cl.
*B65H 19/10* (2006.01)

(52) U.S. Cl.
USPC ..... 242/559.2; 242/533.4

(58) Field of Classification Search
USPC ..... 242/533, 533.2, 533.4, 533.7, 533.8, 242/558, 559, 559.1, 559.2, 560
See application file for complete search history.

(56) References Cited

U.S. PATENT DOCUMENTS

| | | | | |
|---|---|---|---|---|
| 5,243,183 | A * | 9/1993 | Barron et al. | 250/222.1 |
| 5,335,167 | A * | 8/1994 | Boyd | 700/126 |
| 5,499,775 | A * | 3/1996 | Vander Groef | 242/476.7 |
| 6,007,017 | A * | 12/1999 | Vorwerk | 242/559 |
| 6,955,320 | B2 * | 10/2005 | Martinez | 242/555.1 |
| 7,351,948 | B2 * | 4/2008 | Appleyard | 340/507 |
| 7,784,730 | B2 | 8/2010 | Heimrich et al. | |

(Continued)

FOREIGN PATENT DOCUMENTS

| | | | |
|---|---|---|---|
| DE | 295 00 873.3 | A1 | 1/1996 |
| DE | 100 08 221 | A1 | 8/2001 |
| DE | 102004038906 | A1 | 3/2006 |
| DE | 102005030829 | A1 | 1/2007 |

(Continued)

*Primary Examiner* — William A Rivera
(74) *Attorney, Agent, or Firm* — Mattingly & Malur, PC

(57) ABSTRACT

A reel changer of a printing press has a securing assembly for a safety area. The safety area extends on a receiving end or on a dispensing side of the reel changer at least over the entire width to the end-face side frames. These side frames comprise vertically supported frame parts and optionally also include switch boxes end or side boxes that are arranged directly on the side frames. The safety area is substantially completely enclosed by the reel changer and by one or more connected units and or mechanical blocking devices and by one or more sensor-monitored access assemblies in such a way that operators can enter during operation only by the use of the one or more monitored access assemblies. A control element for controlling functions of the reel changer is physically separate from the reel changer and is arranged at a distance from the side frames at a location that can be reached by an operator positioned outside the safety area.

19 Claims, 18 Drawing Sheets

(56) References Cited

U.S. PATENT DOCUMENTS

| | | | | |
|---|---|---|---|---|
| 7,975,608 | B2 | 7/2011 | Beck et al. | |
| 8,011,871 | B2 | 9/2011 | Lehrieder et al. | |
| 2003/0146338 | A1* | 8/2003 | Hogberg et al. | 242/596.1 |
| 2007/0095225 | A1 | 5/2007 | Bernard et al. | |
| 2007/0102556 | A1 | 5/2007 | Wysokowski et al. | |
| 2008/0055081 | A1* | 3/2008 | Lea | 340/555 |
| 2011/0180651 | A1* | 7/2011 | Akpan | 242/535.1 |
| 2011/0202161 | A1 | 8/2011 | Krieger et al. | |

FOREIGN PATENT DOCUMENTS

| | | | |
|---|---|---|---|
| DE | 10 2006 013 955 | B3 | 10/2007 |
| DE | 102007025800 | A1 | 12/2008 |
| DE | 10 2008 042 813 | A1 | 4/2010 |
| EP | 1 644 191 | B1 | 4/2006 |
| EP | 001 986 942 | A1 | 11/2008 |
| WO | 2005 080241 | A2 | 9/2005 |
| WO | 2007 096007 | A1 | 8/2007 |
| WO | 2009 050332 | A1 | 4/2009 |

* cited by examiner

51

REEL CHANGER HAVING A SECURING MEANS FOR A SAFETY AREA

CROSS-REFERENCE TO RELATED APPLICATIONS

This application is the U.S. national phase, under 35 USC 371, of PCT/EP2010/064665, filed Oct. 1, 2010; published as WO 2011/088905A1 on Jul. 28, 2011 and claiming priority to DE 10 2010 001 014.6, filed Jan. 19, 2010, the disclosures of which are expressly incorporated herein by reference.

FIELD OF THE INVENTION

The present invention relates to a reel changer having a device for protecting a secured area. The device extends, on either a receiving side and/or a discharge side, at least across the entire width of the reel changer and up to the end side face frames. The device includes vertical supporting frame parts along with any switch boxes and/or side boxes that are arranged directly on these frame parts. The secured area is substantially fully enclosed on one side by the reel changer and by one or more adjacent units or mechanical blocking devices and by one or more sensor-monitored access points. An operational entry by operators is possible only via the monitored access point or points.

BACKGROUND OF THE INVENTION

From DE 10 2007 025 800 A1, a device for protecting a hazardous area of a reel changer is known, wherein a secured area for the automatic reel loading of the reel changer extends on a receiving side and/or discharge side at least across the entire width up to the end face side frames, and is substantially delimited on one side by the reel changer and by one or more adjacent units and/or mechanical blocking devices and by one or two access points which are monitored by sensors to prevent undetected access.

From WO 2005/080241 A2 it is known to provide a zone safety device for ensuring occupational safety in the area in which large reels of material are being moved. Proposed in this case is the placement of a perimeter fence at the boundaries of a material reel storage area. To allow reels of material to be transported into or out of the storage area, a transfer lock can be provided in the zone safety device. In the transfer lock area, a preferably contactless zone safety device is proposed, which can be implemented, for example, by means of photoelectric sensors or ultrasonic sensors. Arranging sensors of these types at different heights allows complex scanning routines to be achieved, so that, for example, reels of material can pass through the transfer lock without problems, whereas an unauthorized passage through the sensor paths triggers an alarm and/or halts the movement of the material reels, in order to prevent accidents.

EP 1 986 942 A1 relates, for example, to a reel changer having a reel grille for protecting operators in the event of a core burst during operation of the printing press. A control panel for the reel changer is shown on a side frame of the reel changer. The control panel on the side frame of the reel changer is also described, for example, in EP 1 644 191 B1.

DE 295 00 873 U1 discloses an intelligent light barrier for monitoring planar secured areas. To avoid triggering an alarm or a shut-off when a "non-hazardous and pre-programmed" entry occurs, based upon the sequence in which spaced light beams are interrupted and a comparison thereof with a pattern of interruptions that are classified as non-hazardous, a scanning and comparison step prevents a triggering of the alarm or of a shut-off in the case of "non-hazardous" entries.

From DE 10 2004 038 906 A1, a method and a device for detecting moving objects in a monitoring system is known, wherein on the path of transport in front of a light barrier a detection system is provided, by means of which the object to be guided through the light barrier is identified. Passage through the light barrier is permitted based upon this identification.

DE 10 2005 030 829 A1 discloses a light barrier that is tilted in relation to vertical, wherein, on the basis of the sequential interruptions of individual light beams caused by an object passing through, information about the entry of an allowable or non-allowable object is obtained.

SUMMARY OF THE INVENTION

The problem addressed by the invention is that of providing reel changers having an improved device for protecting a secured area.

The problem is solved according to the invention by the provision of a control element for functions of the reel changer and which is located structurally separately from the reel changer and which is spaced from the side frame at a location which can be reached by an operator located outside of the secured area. The secured area, that is located on the receiving side and/or the discharge side of the reel changer, extends, on a loading side, not only up to the frame outer alignment, i.e. an alignment which continues the exterior side of the side frame on the loading side perpendicular to the reel changer axis, but from the reel changer further outward beyond the alignment of the exterior side frame. The sensor monitoring access point, which is provided on the loading side, is arranged on a side of the frame outer alignment that is distant from the reel changer, spaced laterally therefrom.

The advantages to be achieved by the invention consist particularly in that moving a control panel to a location where it can be operated from outside the secured area and/or from an extension of the secured area that includes a transfer point, at least on the reel loading side, contributes to a substantial increase in safety.

More particularly, an improved device for securing a hazardous area based upon safety mechanisms that operate in a contactless fashion is provided for the area in which reels are automatically loaded onto a reel changer, wherein said device ensures continuous protection of the secured area, even in the case of different reel diameters and during the removal of residual core containers. By "expanding" the secured area "outward", the widest range of reel sizes can be handled, without limitations resulting from stand-off distances in the case of structurally defined clearance widths (e.g., adjoining units, building walls or pillars, etc.) playing a role. The width of an access point to the secured area can then be substantially increased, for example, so as to allow clearance measurements from fixed edges to be maintained in every case. In this connection, however, a particularly high-performance safety device at the access boundaries, i.e., in the access area, is particularly advantageous.

Particularly advantageous in conjunction with a widened access point are sensor systems that enable differentiation between allowable entry and non-allowable entry through a point of access to the secured area. This also applies particularly to cases in which an allowable object, e.g., a reel, passes through, however, a person passing through the access point at the same time next to the reel is recognized as "prohibited". More particularly, in this case an embodiment is advantageous in which one sensor subsystem enables the detection of allowable entries, reels, and/or transport means, and accordingly blocks a reaction, and a second sensor subsystem is permanently "focused" and is directed toward the entry of persons, for example. For the latter sensor, in certain operational situations the reaction of the safety device with respect to an initiation of countermeasures, for example, halting movement sequences and/or shutting down a machine, can also be or is deactivated. Alternatively, a camera or camera-like device can also be provided as a sensor system, with which a detection result obtained from an evaluation unit is verified with respect to allowability.

In a particularly advantageous embodiment, the safety device has a contactless sensor system which is connected to an evaluation unit. In this case, the safety device and/or the sensor system are embodied with a light barrier, for example, which comprises a plurality of light beams extending parallel to one another. The evaluation unit detects the sequence in which the light beams are interrupted when any object is transported in and/or out, and from this can recognize a known object and in predefined cases can deactivate the safety device or parts thereof.

In an advantageous further development, in addition to a safety function the safety device also has an integrated muting function (deactivation or partial deactivation based upon the analysis of the signals of the sensor system), which saves on the expense of installing an additional device for the muting function. This muting function of the sensor system itself can be implemented in that objects can be distinguished as allowable or prohibited based upon the pattern of passage through the plurality of light beams—particularly by means of an appropriate circuit and/or implemented analysis routine. For example, it can generally be provided that—at least within a height range to be considered—only one continuous area of light beams arranged one above the other can be interrupted simultaneously. The embodiment of the allowable (loaded or unloaded) transport means is then selected accordingly. However, a person passing through cannot meet these criteria.

A so-called muting function permits a temporary deactivation of parts of the safety device or of the entire safety device. With this, the entry of objects is preferably permitted without actuating the safety device.

In the case of one preferred embodiment, the light beams are spaced evenly from one another and extend tilted in relation to horizontal, wherein in other embodiments the light beams can also be arranged extending horizontally with the surface of the light barrier tilted in relation to vertical.

At least one light beam of the light barrier, said beam extending above the known object, can advantageously be permanently active in order to detect the entry of a person or a non-allowable object into the secured area in which reels are automatically loaded onto the reel changer, even when said person or object enters the secured area together with the known object for which entry is permitted with a partially deactivated safety device (e.g., the light beams provided further below).

The known object that is allowed entry can, for example, be a material reel, a residual core container or a driverless transport vehicle.

Independently thereof, the safety device, rather than the integrated muting function or also in addition thereto, can comprise at least two photodiodes, for example, reflective photodiodes, for muting, which are connected to the evaluation unit. In a preferred embodiment, particularly four reflective photodiodes are incorporated as a muting group (two upstream of and two downstream of the light barrier). With this, objects, particularly residual core containers, can be detected based upon a reflective strip glued to the side thereof, for example, and the muting function can be activated or the safety device can be deactivated. This may be necessary particularly for the removal of the residual core containers, the shape of which is different from that of the reels. For example, if only reels are implemented in the evaluation unit as known objects (based upon the shape and the simple analysis of the sequence of interruptions of the light beams), then the muting function can be implemented on the residual core container by means of the reflective strip. Residual core containers are frequently removed using driverless transport vehicles (AGV=automatic guided vehicle). In order to pass through the secured area, these must also be equipped with reflective strips for muting, or a corresponding interruption sequence for the light beams of the light barrier must be known in the evaluation unit (internal muting), in order for the AGV to be recognized as a known object for which entry into the secured area is allowed.

To secure the protected area against the entry of persons or objects together with the known object while the sensor system is (partially) deactivated or the safety device is partially activated, the safety device can have a second, permanently active, contactless sensor subsystem that comprises at least two light beams, for example, which intersect a short distance above the known object and in their continued path pass close by the known object.

These two light beams therefore extend parallel to and spaced only a few millimeters to a few centimeters from imaginary tangents on the upper half of the known object. The lower ends of the two light beams are therefore located substantially below the upper edge of the known object and can lie close to the axial plane of the known object, depending on the selected angle of inclination.

In an advantageous further development, in addition to the sensor subsystem embodied, for example, as a light barrier, a second, permanently active, contactless sensor subsystem can be provided, whereby a reliable, permanent means for protecting a secured area can be implemented, even when the known object is a reel having a larger reel diameter. The beam path does not permit inadvertent passage over or inadvertent passage under the beams of the second safety device. Passage under the beams is possible in any case for persons moving in a severely bent position. However, even the best safety device cannot protect against all eventualities or against all deliberate circumvention. It cannot be the task of such a device to reliably prevent intentional entry in every case.

In one advantageous embodiment, a plane formed by light beams of the light barrier can be tilted in relation to a vertical plane, which extends parallel to the boundary of the access point to be secured, for example. In this manner, an object with a vertical leading edge entering in the direction of transport will interrupt the light beams successively in a continuous sequence. However, a person entering inadvertently will not do so. Minor fluctuations in vertical alignment, such as can result, for example, from winding defects, will be "compensated for" by the angular offset of adjacent light beams. In this case, the "resolution" and/or the "dimensional tolerance" can be optimized by the distance of the light beams and/or the degree of inclination.

BRIEF DESCRIPTION OF THE DRAWINGS

Embodiment examples of the invention are illustrated in the set of drawings and will be specified in greater detail in what follows.

The drawings show.

DESCRIPTION OF THE PREFERRED EMBODIMENT

Figure 1:
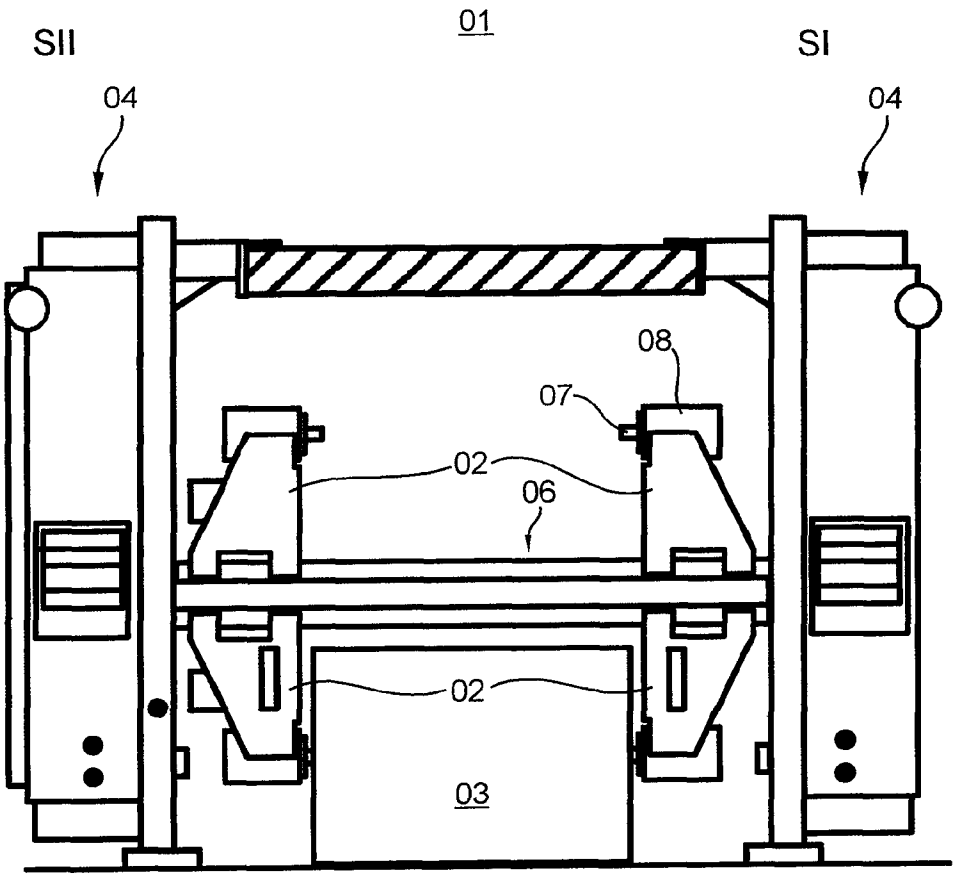
FIG. 1 a schematic front view of a reel changer.

A reel changer 01 has at least one pair of support arms 02 for supporting a reel 03, for example, material reel 03, at the end faces thereof, which pair(s) of support arms is or are mounted on a continuous or divided cross bar 06, which is mounted in end face side frames 04, for example, so as to pivot about its longitudinal axis. In this case, side frame 04 is considered to comprise, for example, all of the vertical supporting frame parts along with any switchboxes and/or side boxes that are arranged directly on these frame parts. Other adjacent units or components are preferably not included. The total width of the reel changer 01 therefore extends from exterior frame side (including any side boxes) to exterior frame side (including any side boxes). To be able to receive a reel 03 and/or release a residual reel the support arms 02 can be pivoted via the cross bar 06 by means of a drive motor, not shown. To support the reel 03, each support arm 02 is equipped with an appropriate supporting device 07, for example, a mandrel 07, which engages inside a reel core, wherein for each pair, preferably at least one mandrel, but particularly both, are positively rotationally driven—for example, by means of a drive motor 08. Preferably, the support arms 02 are embodied as positionable in the longitudinal direction of the cross bar 06 over at least one adjustment range, in order to enable, for example, a release/engagement of the mandrels 07 and/or an adjustment to different reel widths.

On a front side of the reel changer 01, e.g., a receiving and/or discharge side, a receiving and/or discharge area of the reel changer 01 is accessible to a reel 03 in order to allow a reel change thereof. In principle, a reel 03 to be received can be transported by an elevating platform truck or other transport devices to the changing position of the receiving and/or discharge area. Preferably, it is transported to a transfer table and/or lift table 09, which can be moved with at least one component that is radial in relation to the reel changer axis, with the movement of said table, for example, together with the positioning of the support arms 02, enabling a receipt or a discharge. Preferably, however, the receiving and/or discharge area is loaded with a new reel 03 using an automated (i.e., automatically moved, for example) system by means of a suitable transport means 11. This can consist of a rail-guided reel cart 11, as illustrated, which can be transported under automatic control, for example, along a transport path 10 parallel to the reel changer axis into the receiving and/or discharge area, particularly onto the transfer table and/or lift table 09, or can consist of a driverless transport system (=DTS or an AGV=automatic guided vehicle), which transports the reel 03 directly to the changing position or onto a transfer table and/or lift table 09 provided in the receiving and/or discharge area. Preferably, the process of loading a new reel 03 into the receiving and/or discharge area and/or the process of removing a discharged residual reel from the receiving and/or discharge area are carried out automatically by means of a corresponding control system. The receipt of the new reel 03 or the discharge of a residual reel by the reel changer 03 (optionally with the support of a transfer table and/or lift table 09) is then also carried out automatically, for example.

In one illustrated advantageous embodiment, a new reel 03 is transported from a storage area, not shown, to a transfer point 12 assigned to the reel changer 01 to be loaded by way of an outer loading loop. Said loop can be embodied either as manually controlled or operated transport means (e.g., forklift, rail-mounted reel cart, elevating platform truck or a combination thereof) or at least in part as driverless, automated systems (e.g., DTS, AGV, system-controlled rail-mounted reel cart or combinations thereof). At the transfer point 12, for example, the new reel 03 is then transferred to an inner loading loop, by which the reel 03 is positioned for the reel change, and by which a residual reel or core that has been removed is transported out of the reel changer area. The inner loading loop in this case comprises a rail-mounted, automatically driven reel cart 11, which can be moved from the transfer point 12 to the transfer table and/or lift table 09. The control of the transfer table and/or lift table 09 and that of the support arm movements are advantageously linked to one another by logic systems in such a way that a coordinated movement of both sides enables an automatic reel change without external intervention. Loading with new reels 03 can be carried out, for example, from a first side, e.g., from a loading side SI, to the reel changer 01. Residual reels and/or cores can be disposed of, for example, via a transport means 13 provided for this purpose (e.g., a rail-guided, particularly also automatically operable residual reel container and/or residual core container 13), on another side, for example, residual reel side SII.

Both the automatic loading with new reels 03, particularly in the inner loading loop, and the automatic reel changing process itself present substantial risk to operators located in the area. For this reason, as was described above in reference to the prior art, a plurality of safety options have already been proposed, which are intended to minimize the risk of an accident. For this purpose, for example, a secured area has already been provided directly in the area of automatic reel loading, i.e., in the receiving and/or discharge area (changing area), which is delimited on one side by mechanical blocking devices and on the other side by sensor-monitored access points.

In an embodiment illustrated in the set of figures, the risk is now reduced by the fact that operators are no longer necessarily required to enter the hazardous area, and more particularly, cannot be allowed to enter the area undetected. This is accomplished in that, on the receiving and/or discharge side of the reel changer 01, a secured area 17 is provided, which is substantially fully enclosed on one side by the reel changer 01 itself, by one or more adjoining units and/or mechanical blocking devices 14 and/or blocking element 14, for example, fences or fence sections, and by one or two sensor-monitored access points 16, in such a way that entry for operational purposes is possible only via the monitored access point or points 16. The monitored access points 16 have an access protection device or a safety device with a sensor system and with means for analyzing the sensor signals. Entry for operational purposes is understood as normal access that does not result from forceful action involving destroying or overcoming blocking measures. In contrast to the prior art, in order for the reel changer 01 to be operable without risk to operators, a control device 18, for example, a control panel 18, having at least basic control functions is provided, which is located structurally separately from the reel changer 01 in a location that is accessible to an operator who is located outside of the secured area 17. This control panel 18 is arranged not on the side frame 04 itself, but spaced therefrom, wherein, however, it is connected by means of signals to the control system and/or sensor system of the reel changer 01 and/or of the inner loading loop, for example, via corresponding cables or even wirelessly (optically or via electromagnetic radiation, such as, e.g., radio or W-LAN, etc.). In one advantageous embodiment, the control panel is arranged such that it can be reached and/or operated both from outside and from inside the secured area 17. For this purpose, it can be arranged, for example, so as to pivot such that, in one position the display 19 and/or switching and/or input means assigned to the control panel can be viewed and/or activated by an operator located outside of the secured area 17, and in another position these can be viewed and/or activated by an operator located inside of the secured area 17.

The control element 18 has, for example, at least one display 19, e.g., a display 19, which serves for indicating errors and/or for visualizing the reel changer 01 with the functionalities thereof and/or the inner loading loop. The control panel 18 further has a switch 21 used to "STOP & LOCK" the reel changer 01, optionally along with the inner loading loop, and a switch 22 for the "EMERGENCY-SHUT OFF" of the printing press or the machine section related to the reel changer 01. Additionally, keys 23 for selecting the display of the reel changer 01 and/or the reel 03 and/or the inner loading loop and/or operating or adjustment parameters that relate to reel storage, and keys 24, embodied as a block of numbers 24 (optionally with Escape, Enter, and Clear functions), for example, for modifying and/or inputting numerical values for selected parameters are preferably provided. To simplify the manipulation of screens displayed on the display 19, a cursor controller 26 or a track ball or even a computer mouse can be provided. The keys 23; 24 can be provided in a conventional configuration as individual keys (mechanical, optical, electronic), or some or all can also be provided as areas of a touch-sensitive display 19.

The control element 18 can be arranged on its own stand or on a blocking device 14, e.g., a perimeter fence 14, or on a unit adjacent to the reel changer 01. However, the control panel 18 is provided at a location that allows the operator to operate the control panel 18 while simultaneously allowing him a view into the receiving and/or discharge area of the reel changer 01.

This arrangement of an "external" operating element 18 is particularly advantageous when combined with a measure for expanding the secured area 17, particularly on the loading side SI, not only up to the side frame alignment but from the reel changer 01 or the receiving and/or discharge area thereof farther outward, and/or when combined with an access point 16 monitored by the safety device and/or the sensor system thereof, particularly on the loading side SI, not immediately in the area of the side frame alignment, but farther outward away from the reel changer 01. This expanded area of the secured area 17, extending outward beyond the alignment F of the exterior frame side, and/or the monitored access point 16, which is shifted outward, is preferably provided at least at the level of an alignment of the transport path 10. As was stated above, this expanded secured area 17 is further delimited by appropriate blocking devices 14, by the reel changer 01 itself, by any adjacent units, and optionally by an additional monitored access point 16. On an opposite side, for example, the residual reel side SII, another monitored access point 16, for example, an access point 16 that is also spaced further outward from the alignment F, can be provided.

If the exterior frame side is not formed solely by a flat wall, and instead, individual areas (e.g., individual unit attachments or stepped areas in the cover) protrude from an otherwise predominantly flat outer wall or boundary surface, for example, extending over more than 50%, particularly more than 70%, of the lateral width, the alignment F is to be understood as the horizontal direction which is perpendicular to the reel changer axis, and which continues the outer predominantly flat wall surface. This outer wall, and not individual attachments in the surface thereof, is relevant to safety in terms of a potential crushing hazard.

The description relating to the lateral expansion of the enclosed secured area 17 preferably applies in conjunction with a transfer point 12 from an outer to an inner loading loop, wherein the transfer point 12 is located at the side of the secured area 17. The monitored access point 16 then represents a type of transfer lock 16. This relative arrangement between the boundaries of the secured area 17 and the transfer point 12 prevents an accident that could result from the transfer of a reel 03 weighing a ton, for example, to the inner loading loop. If the control panel 18 is accessible from outside the secured area 17, as described above, then the risk of accidents to operators resulting from the reel transfer is also minimized. In principle, the transport path 10 of the inner loading loop can extend beyond the access point 16—in order, for example, to allow maintenance and/or adjustment of the transport means 11; 13 (e.g., fitting with adapters for smaller/larger reels) on an exterior side. Preferably, however, the transfer point 12 for reels 03 remains within the secured area 17.

If an unplanned or unauthorized entry through the monitored access point 16 is detected by the safety device or the sensor system, an error signal is preferably generated, and as a result, a pending or ongoing transfer process is broken off or a controlled interruption is at least initiated by means of corresponding signals processing via corresponding control means connected by means of signals to the inner and/or outer loading loop. An unplanned entry is understood in the broadest sense as the detection of a signal status of the sensor system which is not expressly authorized as allowable. In the simplest sense, this can be an interruption of one or more beams or acoustic waves of a system comprising one or more transmitter/detector systems arranged in the manner of a barrier. If the system in one embodiment is capable of distinguishing between a reel 03 (or reel cart 11) to be supplied and a disruption (e.g., person) that is different from this, this can be accounted for accordingly in the logic system with respect to "planned" or "allowed" and "unplanned" or "prohibited" entries (disruptions). A "planned" or allowed entry can also occur when, for example, corresponding operational situations are present, such as, for example, a shutdown of the relevant reel changer 01 or even of the machine or section.

For instance, parts of the safety device of the relevant access point 16 can preferably be deactivated, for example, for loading the reel 03, or at least a disruption caused by this can be defined as allowable.

The aforementioned safety measures are particularly advantageous when combined with sensor systems, as this ensures the most reliable possible detection of "non-allowed" entry, but does not block the desired passage of a reel 03 to be supplied or of a transport means 11; 13, for example. The sensor system—at least in part—is preferably embodied as a contactless system, for example, as a system that operates using electromagnetic or acoustic waves.

In one advantageous embodiment, the safety device has a first subsystem or a first sensor subsystem, which is deactivated, for example, with the passage of a reel 03, or at least the signal status thereof is classified as allowed or a potential reaction with respect to a reaction resulting from a change in status is blocked. These options are to be understood in what follows as a deactivation of a sensor system or of a sensor subsystem.

Additionally, the safety device has, for example, a second, permanently active, contactless subsystem or a second sensor subsystem for permanently securing the area surrounding the reel 03.

The first sensor subsystem comprises a plurality of light beams 31, e.g., two, which secure the area that can be traversed by a reel 03 or a residual reel container and/or residual core container 13, wherein the first sensor subsystem can be deactivated in order to enable entry and exit. In cases where only a reel 03 to be transported into the secured area is mentioned, the description refers similarly to a residual reel container and/or residual core container 13, a reel cart 11, or a driverless transport vehicle to be transported in, and to the inverse sequence of movements with the transport of the reel 03, a reel cart 11 or the residual reel container and/or residual core container 13 and/or the driverless transport vehicle out of the area.

The second sensor subsystem comprises, for example, a light beam 32 projecting horizontally in a first embodiment, and spaced, for example, at least 50 mm from the largest (maximum processable) reel diameter. In the case of larger reel diameters, however, a second safety device embodied in this manner has proven disadvantageous. As is clear from FIG. 3*a*, the hazard exists that a smaller person could enter the secured reel loading area along with the reel 03, and could thereby become injured by moving machine parts or by the moved reel 03.

Figures 3A, 3B, 3C:
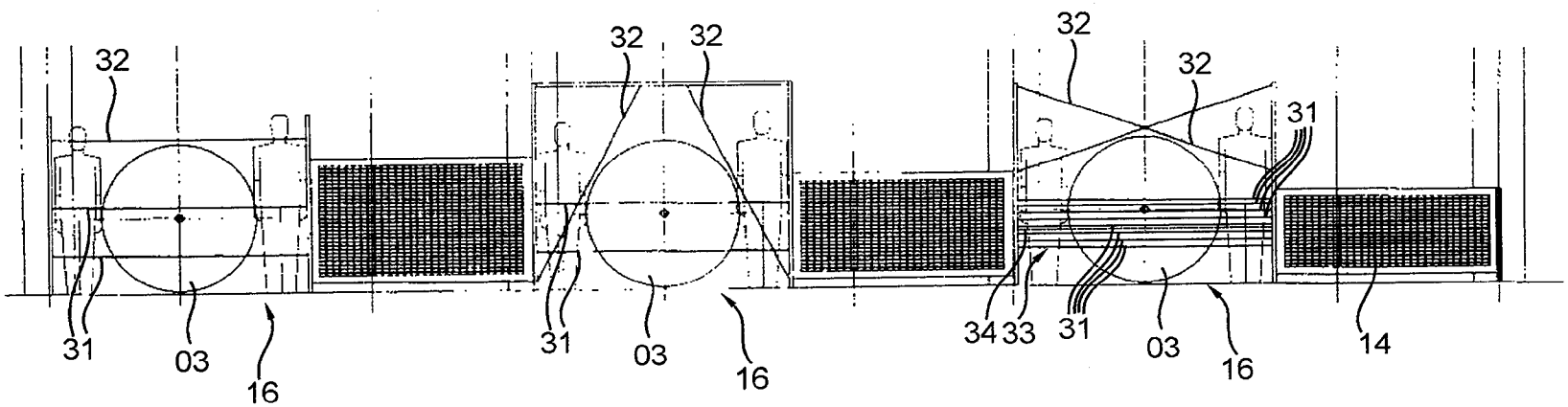
FIG. 3 embodiments of a sensor system for monitoring an access point comprising a) two sensor subsystems with parallel light beam paths, b) two sensor subsystems with horizontal and tilted light beam paths and c) two sensor systems with horizontal and tilted light beam paths.

FIG. 3*b* shows an advantageous configuration of a safety device for an automatic reel loading area. The safety device again comprises a first contactless, but deactivatable, sensor subsystem at the access boundary or at the access boundaries, i.e., at the access point 16, with two light beams 31 which protect the area that can be traversed by the reel 03 or the residual reel container and/or residual core container 13 or by the driverless transport vehicle. For constantly protecting the area surrounding the reel 03, a second, permanently active, contactless sensor subsystem is used. The second sensor subsystem comprises two light beams 32, which extend, starting from points that lie above the reel 03, past the sides of the reel 03 to an area near the floor. As is clear from FIG. 3*b*, a safety device embodied in this manner also does not offer adequate protection. Because the light beams 32 project past the reel 03 nearly to the floor, the hazard exists that a person walking along next to the reel 03 during loading of the reel, for example, could step over the light beams 32.

FIG. 3*c* shows a further advantageous embodiment of the safety device for the area of automatic reel loading, particularly with a wide access point 16, which is therefore particularly in need of protection. This safety device, in contrast to the aforementioned solutions, has, in a first sensor subsystem, a light barrier 33 having a plurality of light beams 31, e.g., more than 5, particularly more than 10, for a contactless safety device at the access boundaries of the secured automatic reel loading area. The light barrier 33 (or the "trips" thereof) can be deactivated (muted) to allow reel 03 or residual reel container and/or residual core container 13 or driverless transport vehicle to be transported in or out. A second, permanently active contactless sensor subsystem is also provided for permanently securing the area surrounding the reel 03, which system will be described further below. At this point it should be mentioned once again that access boundaries to be secured can be located not only on the loading side SI, but also opposite the loading side SI. Safety devices are to be located on both sides if both sides are freely accessible to persons. The contactless sensor system or sensor subsystem, in combination with an evaluation unit, protects the access boundary 16, i.e., the access point 16, that is to be protected by means of the light barrier 33. With a special supplementary device, described in greater detail in what follows, the first sensor subsystem can be deactivated as described above when an "allowed" object is detected.

Figure 4:
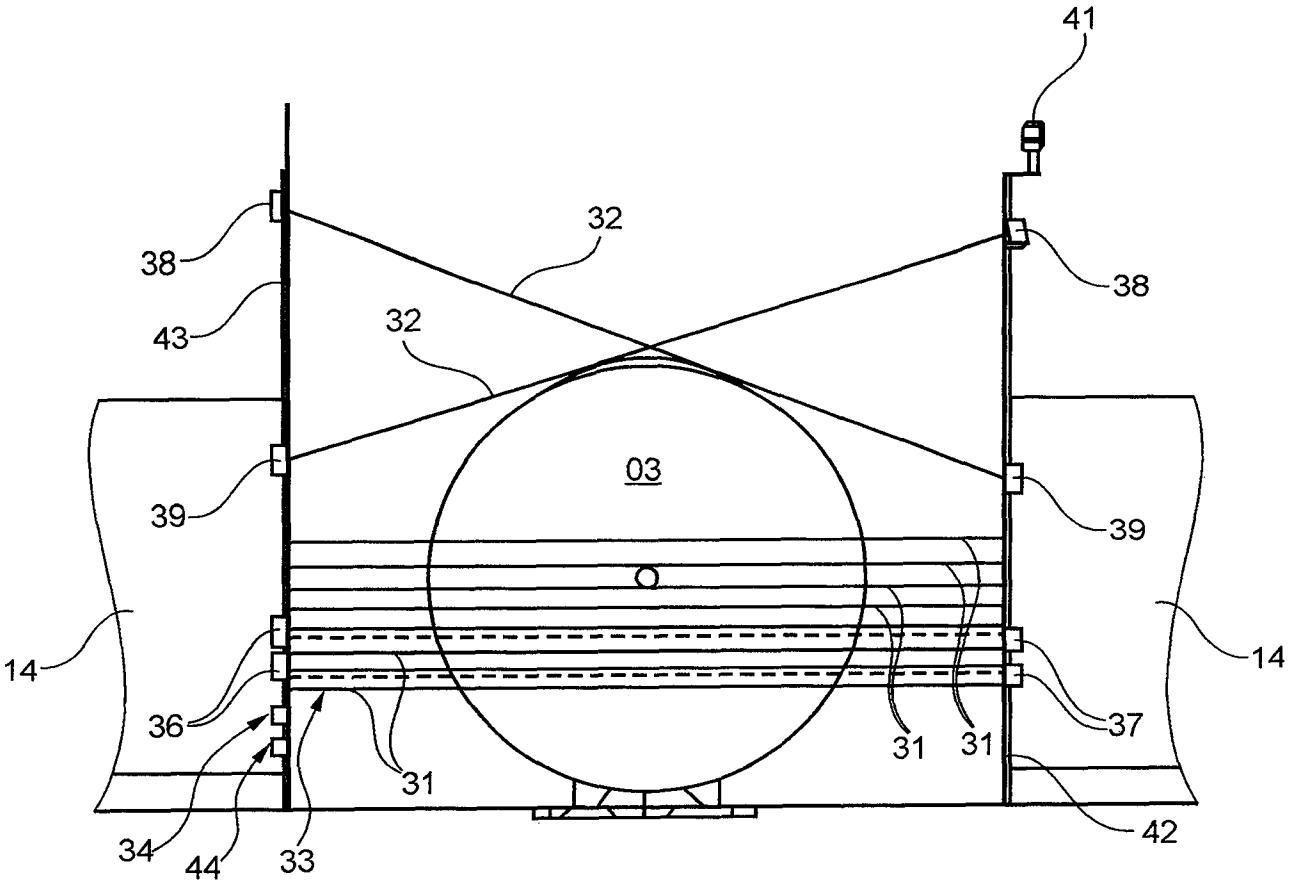
FIG. 4 a schematic front view of a safety device comprising a light barrier.
Figure 5:
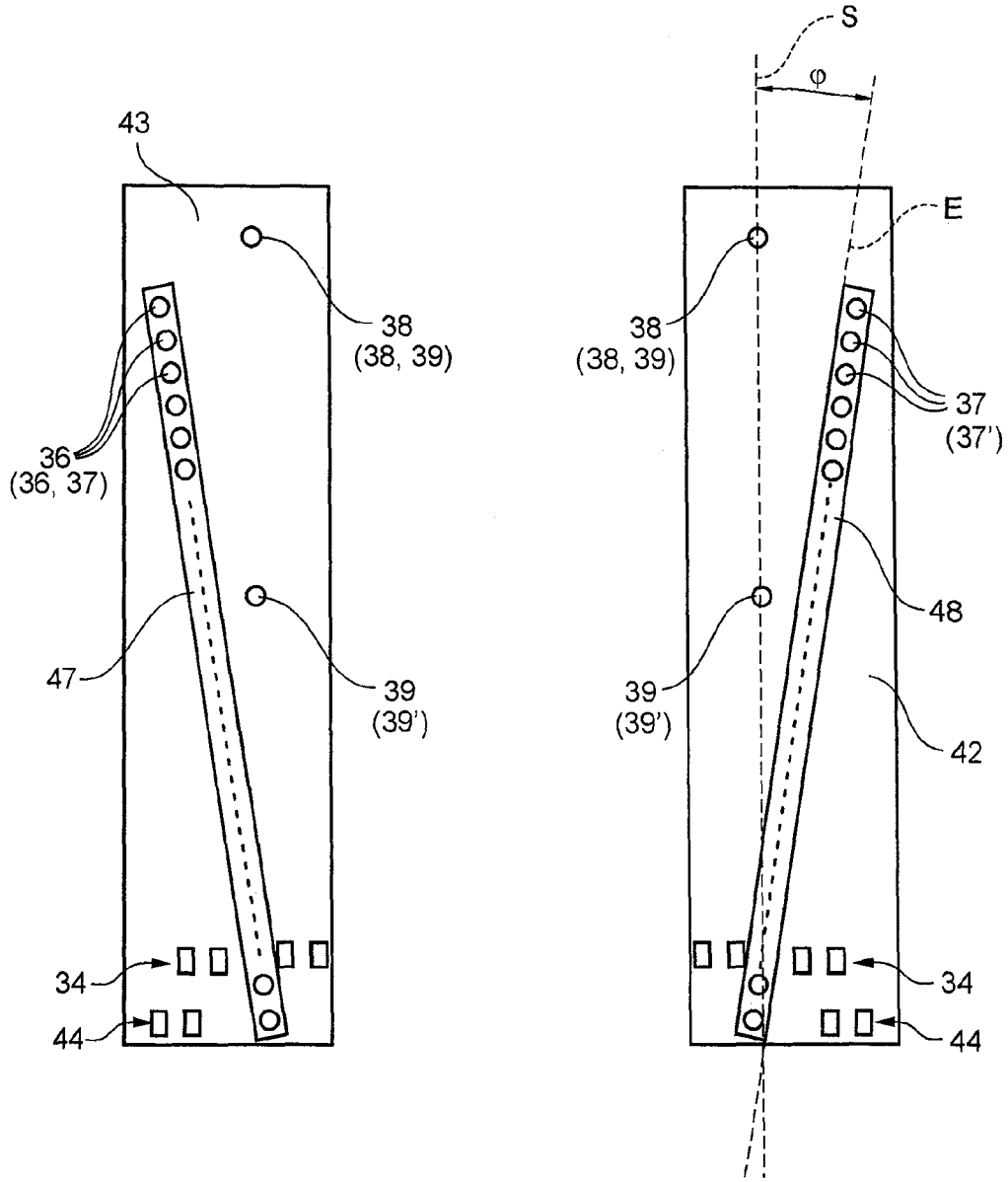
FIG. 5 an illustration showing the arrangement of possible transmitters, receivers and sensors on opposing frame parts of an access point.

In the embodiment example described, the light barrier 33 is formed by a plurality of light beams 31 projecting parallel to one another, for example, substantially horizontally. A transmitter 36 and a receiver 37 (e.g., FIG. 4 and FIG. 5) are assigned to the light beams 31 of the light barrier 33 and are positioned at the end points of the light beams 31. The light barrier 33 is connected to an evaluation unit, which is not shown. The evaluation unit acquires the sequence in which the light beams 31 are interrupted during the transport of a reel 03 or a residual reel container and/or residual core container 13 or a driverless transport vehicle in and/or out, and deactivates the safety device in terms of a reaction with respect to the light barrier 33 when a known object, for which access to the secured area is allowed, is detected. The evaluation unit analyzes, for example, whether the individual light beams 31 of the light barrier 33 are interrupted in succession or are again free. It is irrelevant how many or in what area the individual light beams 31 are interrupted. In general, however, gaps between interruptions of the individual light beams 31, for example, are not permissible. When a reel 03 located on a transport means 11; 13 enters, interruptions will be detected, for example, in an area from the floor up to a certain height, or in the case of "floor clearance", in an uninterrupted intermediate area. In contrast, if a person, rather than a reel 03 or a transport means 11; 13, enters, this type of criterion will not be met. The reel 03 or the transport means or the transport means 11; 13 loaded with a reel 03 should of course be configured such that in no plane of intersection, formed by the light beams 31; 32 arranged one above the other, of the transport means 11; 13 or the system of transport means 11; 13 with reel 03 does a "gap" from the lowest detectable height up to the highest detected height occur.

Independently thereof, the safety device can still comprise at least one sensor, preferably a group of several sensors, e.g., two or particularly four sensors 34, for example, embodied as photodiodes 34, for so-called muting, more particularly, a plurality of reflective photodiodes 34, which are spaced from one another, viewed in the direction of transport T, wherein at least one, e.g., two, of said sensors are arranged in pairs upstream of the light barrier 33, and one or a pair are arranged downstream of the light barrier in the direction of transport T. In principle, one sensor 34 can also be arranged upstream and one downstream of light barrier 33. These serve to deactivate (mute) the light barrier 33 upon detection of a known object, particularly a residual reel container and/or residual core container 13, which, due to their shape, make analysis of the sequence of interruptions of the light beams 31; 32 more difficult, and to activate or reactivate said barrier. In addition, the reflective photodiodes 34 are connected to an evaluation unit, not shown. The group of sensors 34 arranged on both sides of the light barrier 33 interact, for example, in terms of muting in the case of transport means 11; 13, e.g., reel cart 11, and/or residual reel containers and/or residual core containers 13. For detection purposes, the transport means 11, e.g., the residual reel containers and/or residual core containers 13, are equipped with reflective strips at the level of the interacting sensors 34. The light barrier 33, or particularly the analysis it conducts, is muted (switched off, more particularly, deactivated in the manner described above) when the reflective strips on a residual reel container and/or residual core container 13 are detected. Once the residual reel container and/or residual core container 13 has passed through the device for protecting the access point, a reflective photodiode 34 that is last in the direction of transport T, e.g., with a total of four, the fourth reflective photodiode, no longer receives a reflection of the light beam, so that the light barrier 33 is then reactivated. In principle, only one sensor 34 can be provided on each side of the light barrier 33. However, due to a "single-fault tolerance" and/or to avoid an error signal resulting from an incidental external reflection, at least pairs of sensors are advantageously provided on each side. However, if, at least for a period of time that is greater than zero, the reflections located upstream and those located downstream of the light barrier 33 are not detected simultaneously, then unauthorized entry will be detected by the evaluation unit and/or the sensor (sub) system having the light barrier 33 will be reactivated.

In the case of an outer loading loop with a driverless transport vehicle, with one sensor, or with a pair of two sensors 44, particularly two reflective photodiodes 44, the muting function can be implemented only on the exterior side, because the driverless transport vehicle does not pass all the way through the light barrier 33, and instead only partially enters the secured area 17 in order to deliver or transfer the reel 03. The first reflective photodiode 44 detects the reflective strip, for example, which is located on the transport vehicle accordingly at the level at which the reflective photodiodes 44 are positioned, and switches the light barrier 33 off or deactivates at least one reaction of the safety device categorized as "non-allowed". When, on the return trip of the driverless transport vehicle, the second reflective photodiode 44 no longer receives any reflection of the light beam, the light barrier 33 and/or the reactivity thereof is reactivated. For example, upper, e.g., the two uppermost, light beams 31 of the light barrier 33 and/or the analysis thereof remain permanently active, for example, in order to prevent a person or an object from entering the secured automatic reel loading area together with the reel 03 or the residual reel container and/or residual core container 13 while the protection of the hazardous area by the light barrier 33 is deactivated. These two uppermost light beams 31 of the first sensor subsystem then represent light beams 32 of an above-described second subsystem, which in this case is then not expressly required, for example.

In one advantageous embodiment, however, a second, permanently active, contactless sensor subsystem is provided, which comprises at least one light beam 32 that projects transversely above the reel 03 from a transmitter 38 to a receiver 39. More particularly, two light beams 32 are provided, which project transversely in relation to the longitudinal extension or axial direction of the reel 03, and intersect a short distance above the reel 03, with the continued path thereof passing close by the reel 03 or the reel container. The point of intersection of the two light beams 32 preferably lies only a few centimeters, e.g., <15 cm, particularly <8 cm, preferably <5 cm, above the upper edge of the reel, and the light beams 32 then project below the point of intersection at a distance of a few millimeters, e.g., <15 mm, particularly <8 mm, preferably <5 mm up to a few centimeters, past the reel 03. The upper end points of the light beams 32 are therefore positioned above the reel 03, but beyond the reel extension. The lower end points lie below the upper edge of the reel.

As is clear from FIG. 3*c*, the path of the two light beams 31 does not permit inadvertent passage above or inadvertent passage below the light beams 31. At most, passage below the light beams is possible for persons moving in a severely bent posture.

In the illustrated embodiment example, reflective photoelectric sensors can also be used, for example. The second, permanently active, contactless sensor subsystem then comprises, for example, a combined transmitting and receiving unit 38, 39 (rather than transmitter 38) for each light beam 32. The light beam 31 is reflected back to the transmitting and receiving unit 38, 39 by an opposite reflector 39' (rather than receiver 39). The two transmitting and receiving units 38, 39 can then be arranged on the same side or on different sides of the access point 16. This beam guidance can also be used with the light beams 31 of the light barrier 33, in which case the transmitter 36 is also replaced by a transmitting and receiving unit 36, 37, and the receiver 37 is replaced by a reflector 37'. In the case of the second, permanently active sensor subsystem and/or in the case of the light barrier 33, one-way photoelectric sensors, in which transmitter 36 and receiver 37 are arranged opposite one another, can alternatively be used. In the case of alternative embodiments, each of the light beams 31; 32 of the light barrier 33 and of the second permanently active sensor subsystem can have precisely one transmitter 36 and one receiver 37. In these cases, a plurality of deflecting mirrors are necessary for guiding the light beams 31; 32. As transmitter 36; 38, a light-emitting diode or laser diode that emits infrared radiation or visible light can be used, and as receiver 37; 39 a phototransistor can be used. It has proven advantageous for the positions of the transmitting and receiving units 36; 37; 38; 39 and of the reflectors 39', 37' to be adjustable.

In one advantageous embodiment, a plane E formed by a plurality of or all light beams 31 of the light barrier 33 can form a vertical plane that extends along the boundary of the access point 16 to be secured, i.e., coinciding with a vertical plane S that extends along the boundary to be secured. In this manner, an object with a vertical leading edge entering in the direction of transport T will interrupt the light beams 31; 32 simultaneously. However, a person entering inadvertently will not do so.

In a particularly preferred embodiment of the light barrier 33, a plane E formed by a plurality of or by all light beams 31 of the light barrier 33 extends tilted in relation to a vertical plane S, for example, which extends parallel to the boundary of the access point 16 to be secured. In this manner, an object with a vertical leading edge entering in the direction of transport T will interrupt the light beams 31 successively in a continuous sequence. However, a person entering inadvertently will not do so. Minor fluctuations in vertical alignment, such as can result, for example, from winding errors, are "compensated for" by the angular offset of adjacent light beams 31. In this case, "resolution" or "dimensional tolerance" can be optimized by the spacing of the light beams 31 and/or the angle of inclination ϕ between the plane E and the vertical. The light beams 31 (i.e., including the transmitter 36, e.g., on a light strip 47 that forms a structural unit and/or the receiver 37 on a sensor strip 48 that forms a structural unit) are arranged, for example, preferably equidistant from one another, at a spacing of 20 to 100 mm, particularly 30 to 60 mm. The angle of inclination ϕ lies between 8° and 25°, for example.

Figure 6:
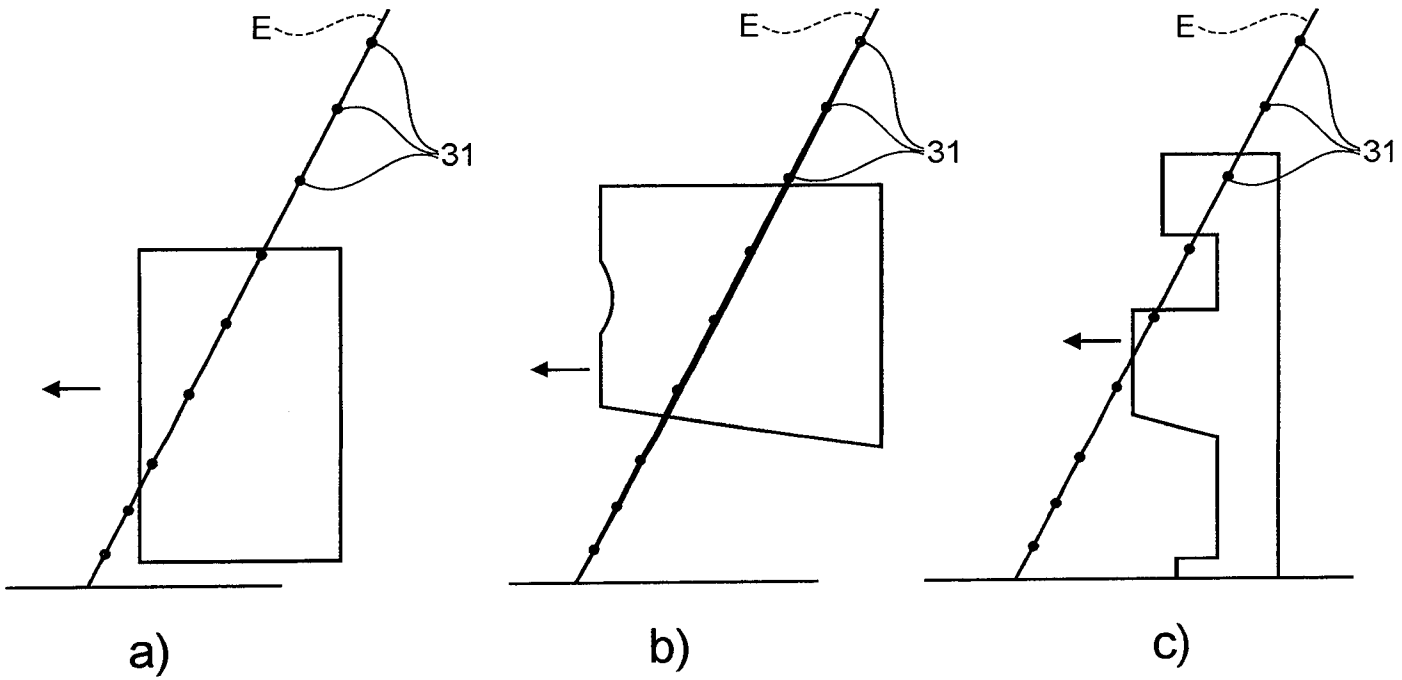
FIG. 6 illustrative schematic illustrations a) and b) for allowed and c) for prohibited objects.
Figure 7:
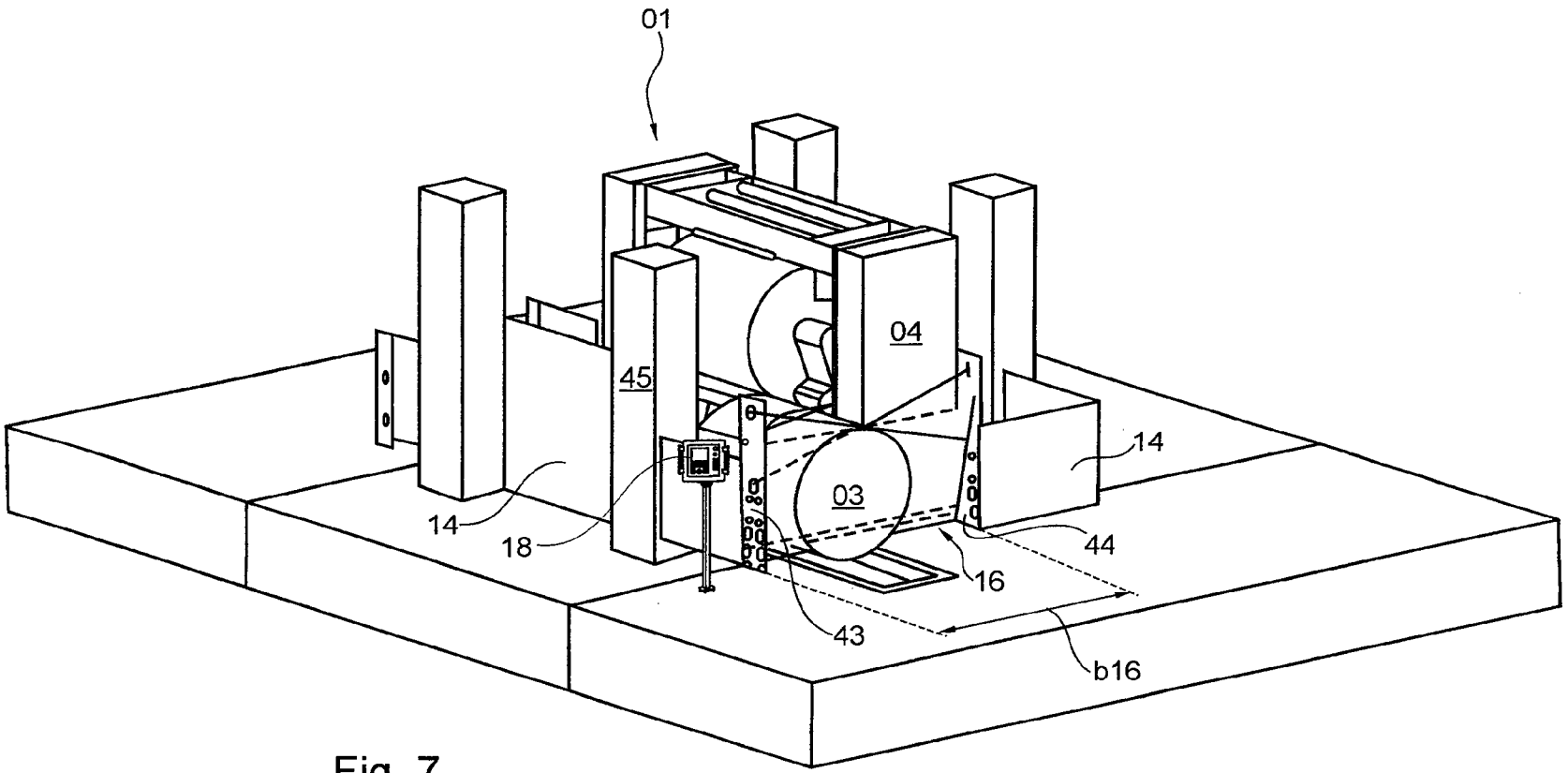
FIG. 7 a perspective illustration of a reel changer with a secured area and a monitored access point.
Figure 8:
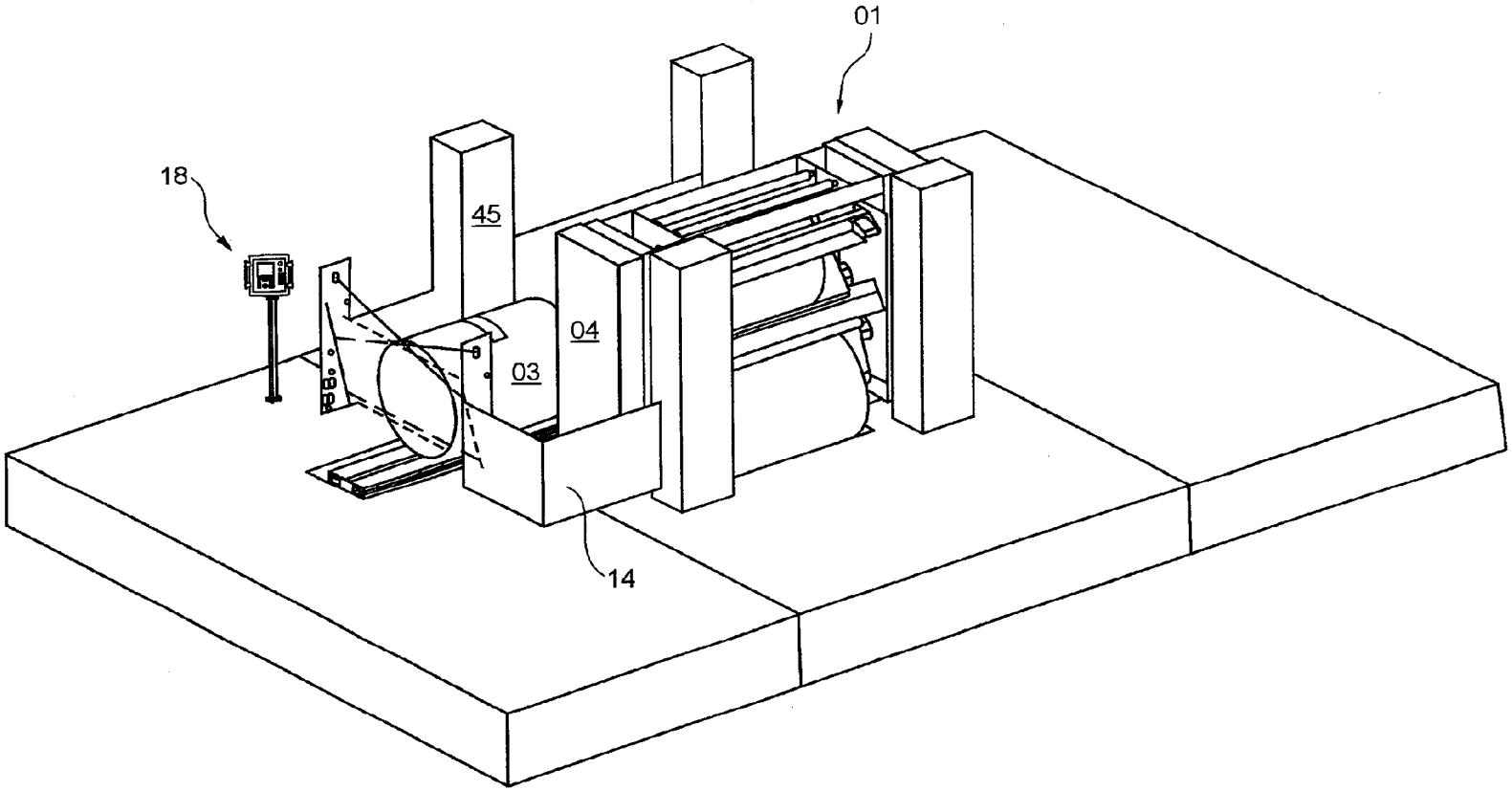
FIG. 8 an illustration of the assembly of FIG. 7 from a different perspective.

With the tilted arrangement of the light barrier 33, combined with discrete light beams 31 spaced from one another in terms of height and transport direction T, a minor sign change, extending over only a small area, in the inclination of the object edge passing through or of the envelope curve that is detectable from the side will be "compensated for". This is illustrated by way of example in FIG. 6, wherein FIG. 6 a) shows a regularly allowed object, b) shows an allowable object with a slight deviation in the leading object edge (e.g., a depression) and a lower edge that angles downward, and c) shows a non-allowable shape with a signal cycle having a non-uniform shape. In the case of a vertically embodied light barrier 33, b) would also be characterized as non-allowable due to the depression, because when the leading edge passes through, a plurality of non-cohesive areas rather than a single cohesive area with interruptions of the light beams 31 would be present.

The various transmitters 36; 38 and receivers 37; 39 along with any muting sensors 34; 44 that are provided are advantageously arranged in two frame sections 42; 43 or columns 42; 43 that delimit the access point 16 laterally and are opposite one another, and which can also be parts of adjacent blocking devices 14. In this case, sensors 34; 44 for muting can also be arranged on only one of the two sides as long as it is ensured that reflective strips of the interacting object are always present at least on the side that faces this side.

Due to the "outward" expansion of the secured area 17, a passage width b16, for example, width b16 of the monitored access point 16, can be increased substantially in relation to a width that is otherwise limited by adjacent, stationary obstructions 45, for example, adjacent units and/or building parts, such as, for example, building walls or particularly building pillars 45 in so-called ("reel cellars"), thereby allowing larger reels 03 to also be automatically supplied.

In another advantageous embodiment, the sensor system can be formed by a group of photoelectric sensors, for example, extending vertically (e.g., in the manner of a "photoelectric sensor or acoustic curtain", with, e.g., vertically extending beams or waves), by one or more line cameras or a surface camera (if possible covering the entire passage width or height of the access point 16), in such a way that a reel 03 as such, but at least, for example, a typical width and/or height and/or shape, can be detected by detection software (pattern recognition) and therefore classified as allowable by an evaluation unit, whereas with disruptions during passage that deviate therefrom laterally (in the case of a vertical beam path) or in terms of height (in the case of a horizontal beam path) a signal is triggered, on the basis of which the passage can be identified as non-operational. When a line camera or linear camera is used, an analysis of this type can be based upon object or edge recognition, for example. Alternatively, as a system having this type of resolution, a laser scanner having appropriate image processing and/or analysis software can be used as the sensor system, which, for example, monitors access over its entire width, and is arranged, for example, at a level above head level, for example, more than 2,000 mm from the floor.

In a further development, the signal processing routine assigned to the sensor system can also be connected to a computer and/or memory device of a higher-level reel transport system and/or to the control system for the reel changer 01 and/or to a control system for the outer loading loop in such a way that information provided there and relating to the size/width of the reel 03 to be supplied is or can be consulted in the analysis with respect to the allowability of access.

The above-described sensor systems, particularly a sensor system having the tilted light barrier 33—with or without the second sensor subsystem and/or with or without the muting option (integrated or with a supplementary device)—, independently of the configuration of the secured area 17 and/or of the placement of the control device 18, e.g., the control element 18, outside the area, viewed independently, in principle also represents an advantageous embodiment as a component of a safety device for securing an access point 16 in the secured area 17 of a reel changer, wherein, for example, a passage width b16 that goes significantly beyond the maximum reel diameter (e.g., by at least 300 mm, particularly by at least 500 mm, on both sides) is to be provided for the access point 16. However, particular advantages with respect to the safety and flexibility that are achieved are apparent precisely in combination with the placement of the control element 18 outside the area and/or the "expanded" secured area 17. In this case, a more convenient, more flexible and more secure access point 16 for the widest range of objects and reel sizes can be provided, wherein operators are not endangered either during operation or during the transfer process, or as a result of inadvertent entry into the secured area 17.

In any case, when an unplanned and/or unauthorized passage through the monitored access area 16 is detected by the safety device, i.e., by the sensor system or a sensor subsystem, an error signal can be generated, and as a result, a pending or ongoing transport or transfer process can be broken off, or a controlled interruption can at least be initiated by corresponding signals processing via corresponding control means that are connected by means of signals to the inner and/or outer loading loop. In the event of damage to (malfunctioning of) various sensor subsystems or for various forms of damage to a sensor system or subsystem, various measures to be triggered by the damage (malfunction) can be provided. It can also be provided that in special cases, or in all cases of malfunction, an optical and/or optical warning device 41, for example, warning light and/or siren, is activated, which is preferably arranged within direct view of the access point 16, particularly in the immediate vicinity of or directly at the access point 16.

The control element 18, which is accessible by the operator and is spaced from the reel changer 01, preferably is not simply a device having a narrowly limited range of optional functions, such as emergency functions, for example, and is instead a full-range control panel 18, which comprises at least the functions of a control panel 18 arranged directly on the reel changer 01, with functions for the reel changer 01 itself and for an inner loading loop (e.g., a transfer table and/or lift table 09 and/or a transport means 11; 13), and preferably also with functions for implementing reel requests from a warehouse or storage area. The control panel 18 with its functions is preferably assigned to a specific reel changer 01 and is arranged so as to be optionally mechanically detachable, but operationally stationary.

Figure 2:
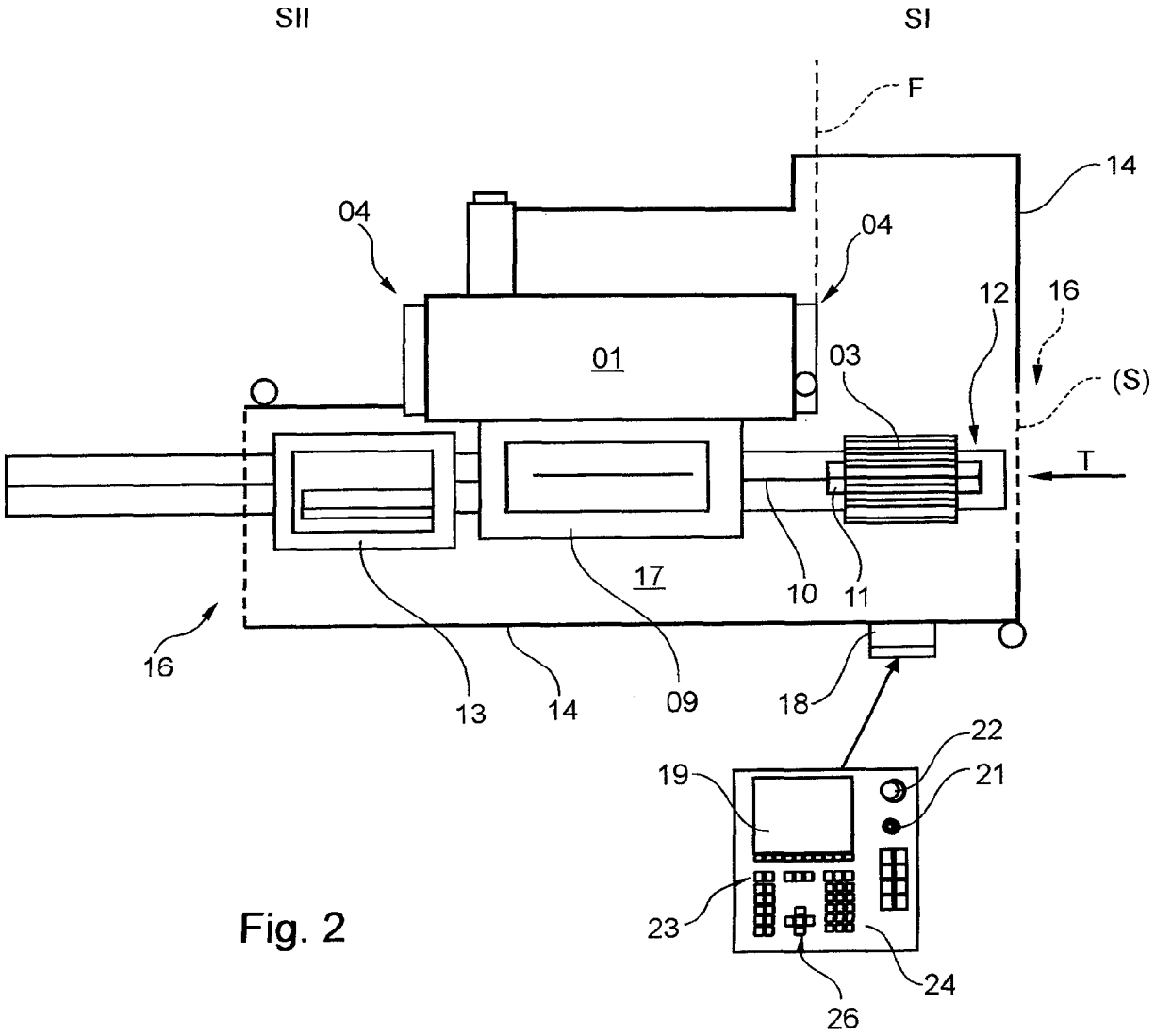
FIG. 2 a schematic plan view of a reel changer with a secured area.

As was already indicated in reference to FIG. 2, in addition to the display 19, the switches 21, 22, the cursor controller 26, and the block of numbers 24, the control device 18 also comprises the keys 23, e.g., function keys 23, by means of which displays relating to specific information and/or units and/or procedures or processes, e.g., so-called screens, can be displayed. Depending on the selection, specific data about the selected information and/or the selected unit and/or the selected process are displayed. In addition to a purely informational display of specific parameters, in some or in all of these screens parameters can also be displayed which can be selected and modified using touch-sensitive areas on the display 19 or by means of keys 24; 26. It is not necessary for all function keys to be provided. For example, in the "overview screen" 46—for example, generally displayed in its initial status—at the lower edge of the screen, the key assignment of the function keys 23 arranged below the display 19 is shown. However, these can instead also be configured as touch-sensitive "keys" that are displayed directly on the display 19. In addition, for example, the reel changer 01, along with the inner loading loop (09, 10, 11, 13, if currently present), is also displayed. In the example, the soft key "F1" is assigned to a screen relating to operational data about the reel changer, "F2" is assigned to a screen relating to data about the transfer table and/or lift table 09, and "F3" is assigned to a screen relating to data about reel storage. The display 19 also serves to indicate errors and to visualize the reel changer 01 and the automatic reel transport system comprising at least the inner loading loop 09, 10, 11 with a transport path 10, a transport means 11; 13 and optionally a transfer table and/or lift table 09.

Figure 11:
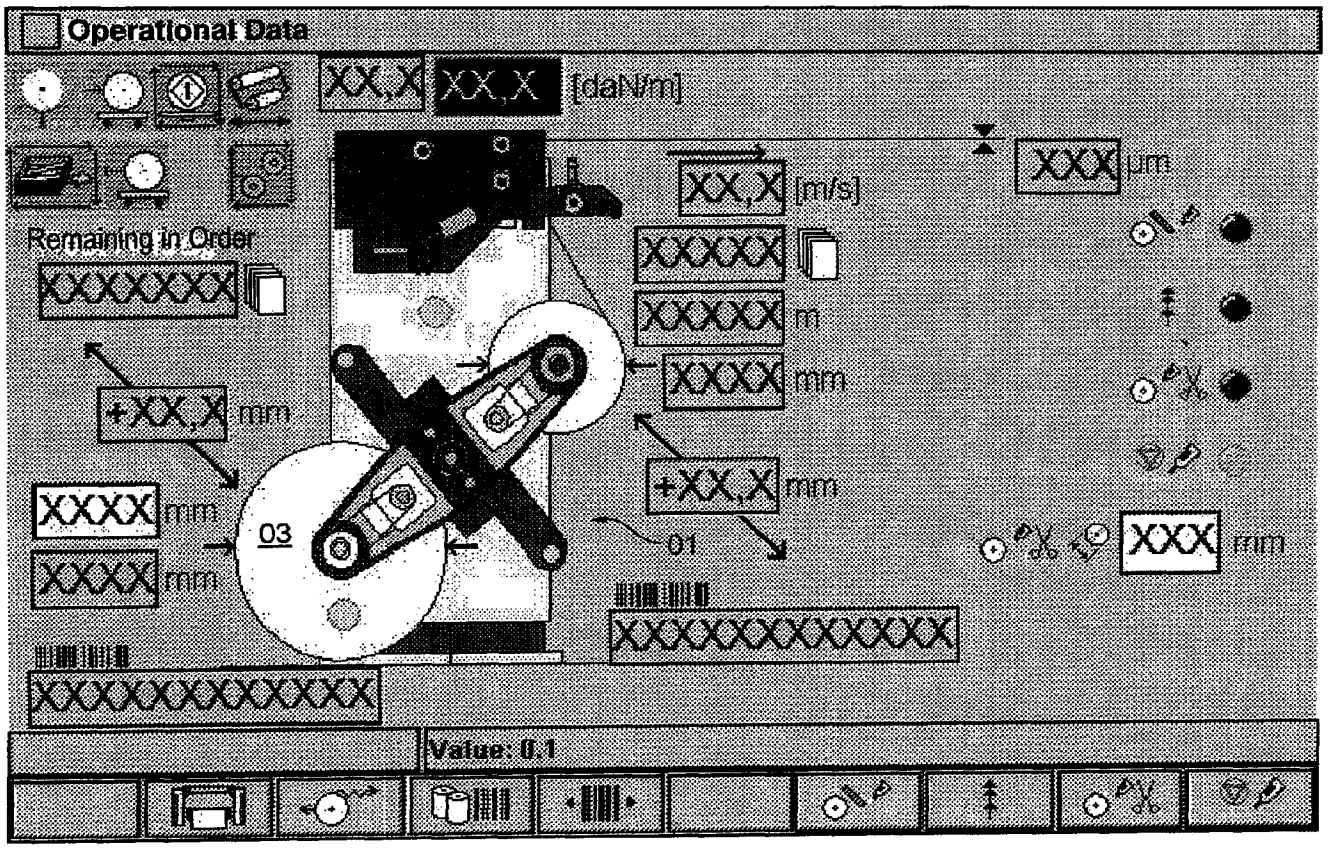
FIG. 11 a schematic illustration of a display in a screen relating to operational data about the reel changer.
Figure 12:
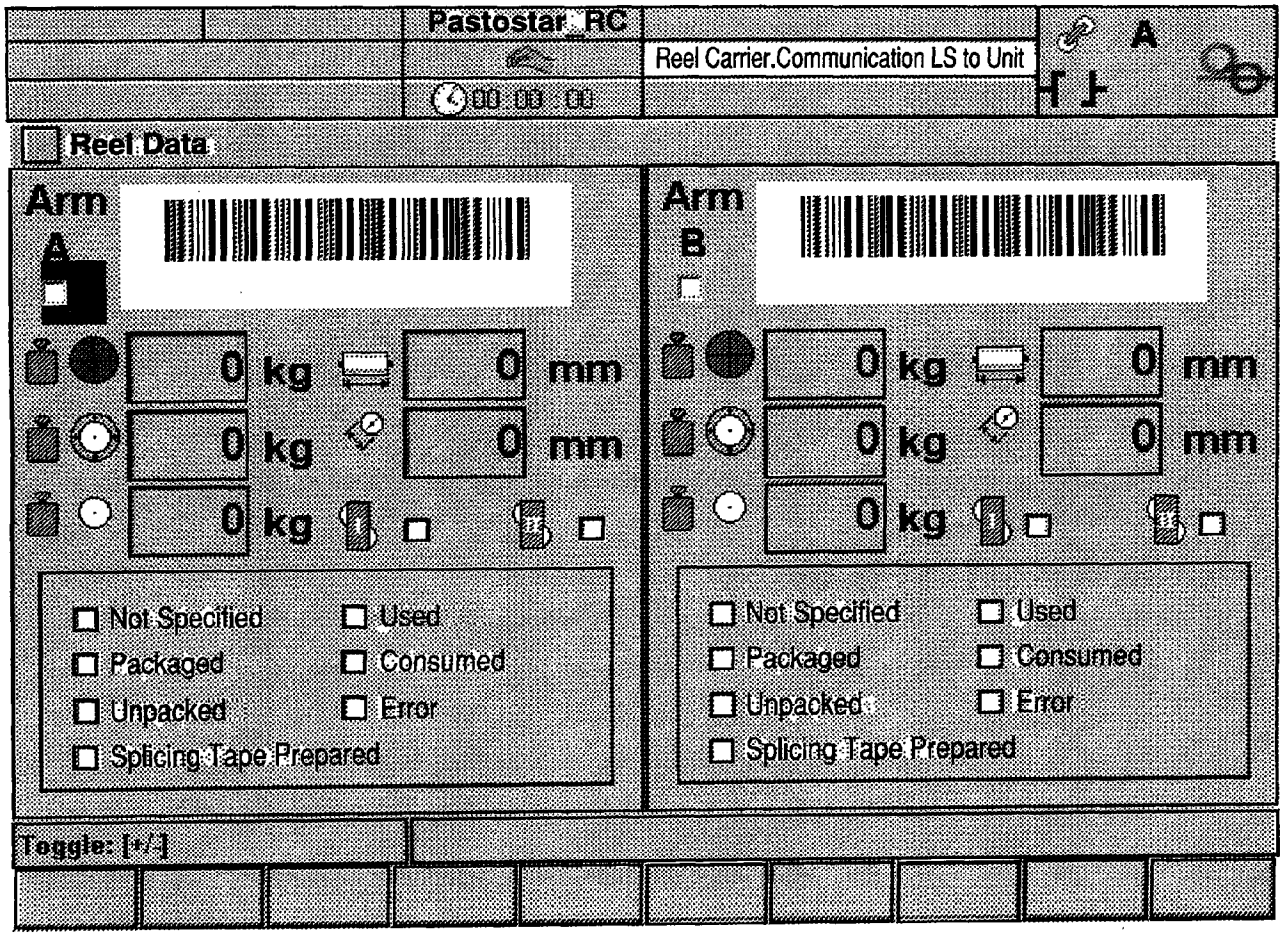
FIG. 12 a subscreen for information relating to the reels located in the reel changer.

For example, the screen for the operational data about the reel changer 01 (FIG. 11) contains information for each of the two pairs of support arms about the reel 03 that may be loaded and preferably about the current web speed, about the current diameters, about the barcodes that identify the reels 03, and, for example, a modifiable value for diameter at which a flying reel change with a splicing and cutting process is to be initiated. At the lower edge, subscreens can again be called up, which contain additional information and/or options for modifications on subjects that are associated with operation of the reel changer. For example (in this case, e.g., using the fifth "function key"), additional information about the two reels 03 supported by the pairs of support arms, for example, the barcodes and/or reel or core weights, and/or lengths and diameters thereof, can be retrieved (FIG. 12).

Figure 13:
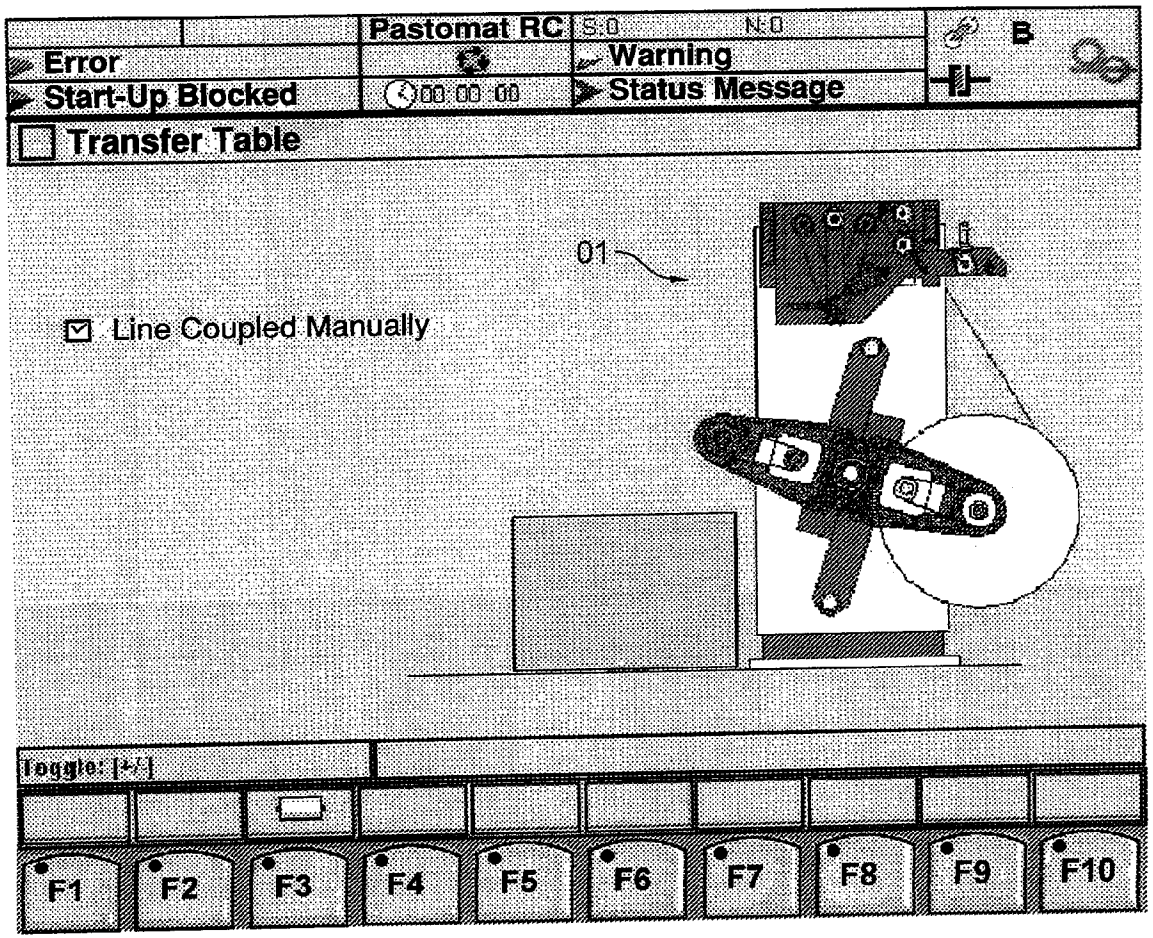
FIG. 13 a schematic illustration of a display in a screen relating to a transfer table and/or lift table.
Figure 14:
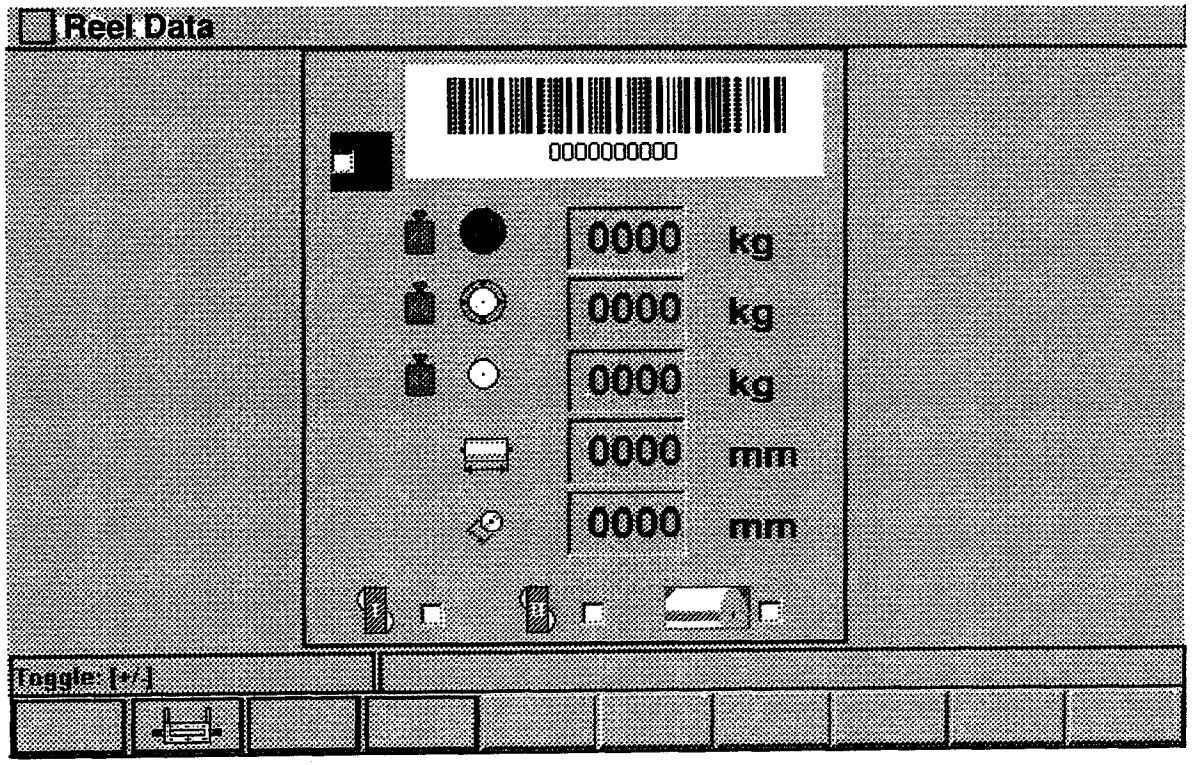
FIG. 14 a subscreen for information relating to the reel to be handled in the area of the transfer table and/or lift table.

FIG. 13 illustrates, by way of example, the screen relating to the transfer table and/or lift table 09. In this case, for example, by entering a corresponding selection ("check mark"), the process can be coupled with processes located upstream in the flow of material, for example in the outer loading loop and/or at an unpacking station. In this case as well, a function key can be used to call up at least one subscreen, which supplies information about the reel 03 to be handled by means of the transfer table and/or lift table 09 (e.g., FIG. 14).

Figure 15:
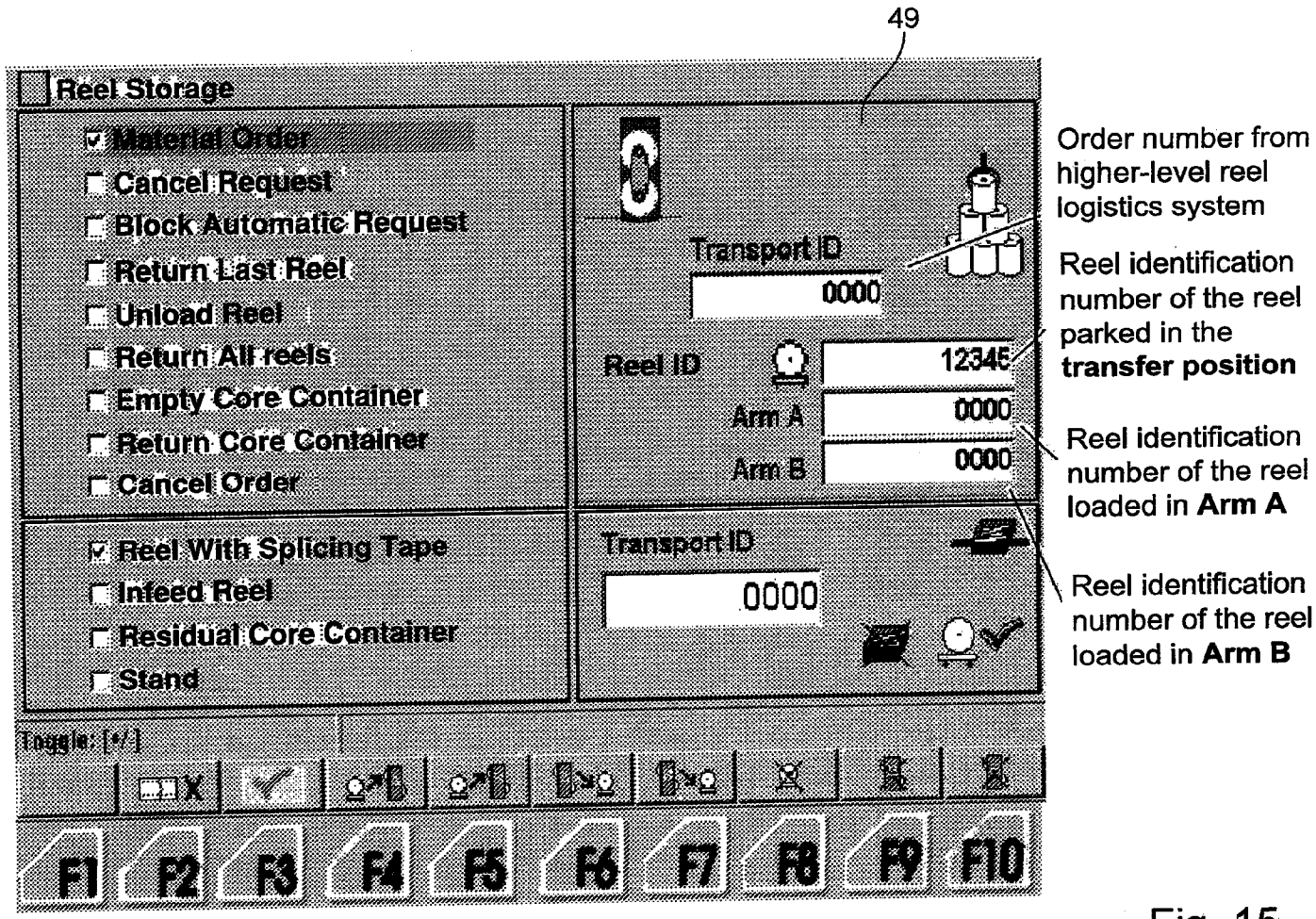
FIG. 15 a schematic illustration of a display in a screen relating to a reel handling and/or a reel storage and/or a reel request.

The screen 49 in FIG. 15 shows, by way of example, a screen for reel storage containing a plurality of manual selection criteria, wherein the "material order" can have various sub-menus based upon the machine, a material order is canceled by checking "cancel request", and if the request has not yet been confirmed, the automatic material request can be blocked by checking "block automatic request". If the selection "return last reel" is checked, the reel 03 will be returned to the transfer position in the temporary storage area, if "unload reel" is checked, the reel 03 on the inactive arm will be returned to the temporary storage area, assuming the transfer position, which has previously been emptied, is empty, and if "return all reels" is checked, all reels 03 will be returned to the temporary storage area (beginning with the reel 03 from the transfer position, and followed by the reel 03 from the inactive arm, and, after a 180° rotation and switch-over of arm activity, the reel from the active arm. If "cancel order" is checked, the orders previously placed will be cancelled, assuming this is permitted by processing. With the optionally provided "empty core container", the core container is moved from the parked position to the transfer position, and with the also optional "return core container", the core container is moved from the transfer position back to its parked position. In the area of the screen below this, ordering and/or delivery can be implemented based upon data relating to reels 03 to be supplied by a higher-level reel logistics system: "reel with splicing tape", "infeed reel", "residual core container" (optional if provided), "stand" (for example, for residual reels).

Function keys (mechanical or touch-sensitive) can be assigned as follows, for example, wherein in this case F1, e.g., is unassigned:

F2: Reel error, F3: Confirmation of command—Execute!, F4: Enter reel ID from transfer position to Arm A. F5: Enter reel ID from transfer position to Arm B. F6: Enter reel ID from Arm A to transfer position. F7: Enter reel ID from Arm B to transfer position. F8: If the reel will be removed manually, actuating this key will delete the reel data in the transfer field. F9: If the reel will be removed manually, actuating this key will delete the reel data in the Arm A field. F10: If the reel will be removed manually, actuating this key will delete the reel data in the Arm B field.

On the right side of the screen 49, for example, in addition to information about the order and about the parked reel 03, for example, information about the reels 03 currently loaded on the support arms 02 is provided.

Figure 16:
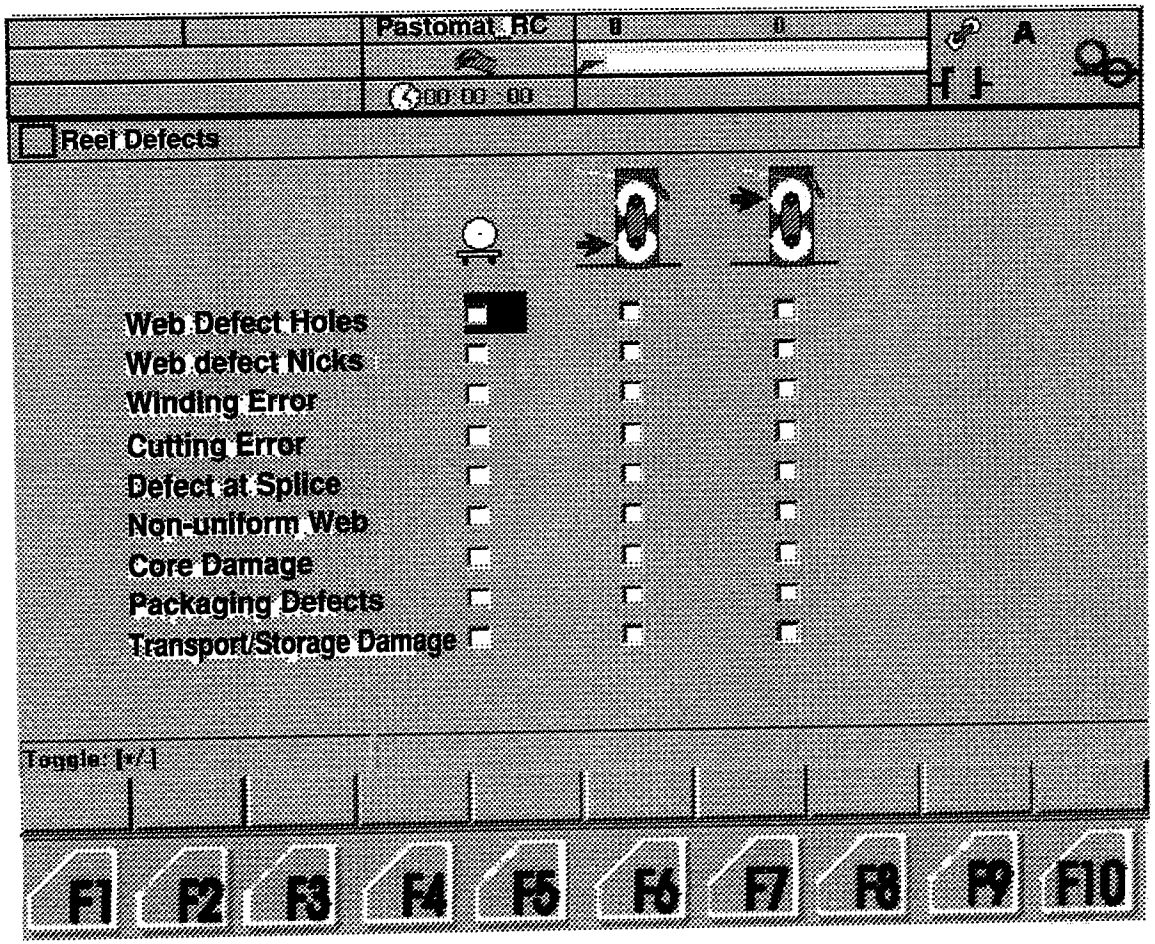
FIG. 16 a schematic illustration of a display in a subscreen that is appropriate for characterizing reel defects.

For example, if a reel 03 is to be unloaded, a check mark should be placed next to the corresponding field, and the selection confirmed, in this case, for example, using "F3". In the subscreen 51 relating to "reel defects" (e.g., FIG. 16), the type of defect in the reel 03 can be entered. The same applies similarly to the remaining commands, such as, for example, "return last reel", "return all reels", etc.

A screen can also be provided for a transport path of an inner and/or outer loading loop, which displays reel data about reels 03 located on different sides of a turntable.

In combination with the "extended" secured area and/or the placement of the control element 18 at a distance from the reel changer 01, the control element 18 can be embodied to support a change in production with a manual and/or semi-automatic change in circumference. A change in production involving a change in circumference means that at least one reel changer 01 is to be loaded at an appropriate time—for example, during the still ongoing production process—with a reel 03, the width of which is different from that of the first reel 03, for a subsequent production run. In other words, with a change in circumference, the reel changer 01 supports two reels 03 of different widths—during at least a period of time after the loading of the second reel 03 and before removal of the first reel 03.

In a system that is fully automated with respect to a change in circumference, for example, the above-mentioned outer loading loop can be part of an automatic storage and transport system. This system automatically performs the storage and/or loading of the reel changers 01 by means of a logic system implemented by computing means. This is preferably carried out on the basis of data and/or instructions that are specified in advance by the printing press control system and/or by a production planning system. Thus, for example, appropriate display and input means for controlling and/or initiating a change in circumference can be specified in advance on a control panel of the printing press, which is connected to the printing press control system.

Figure 17:
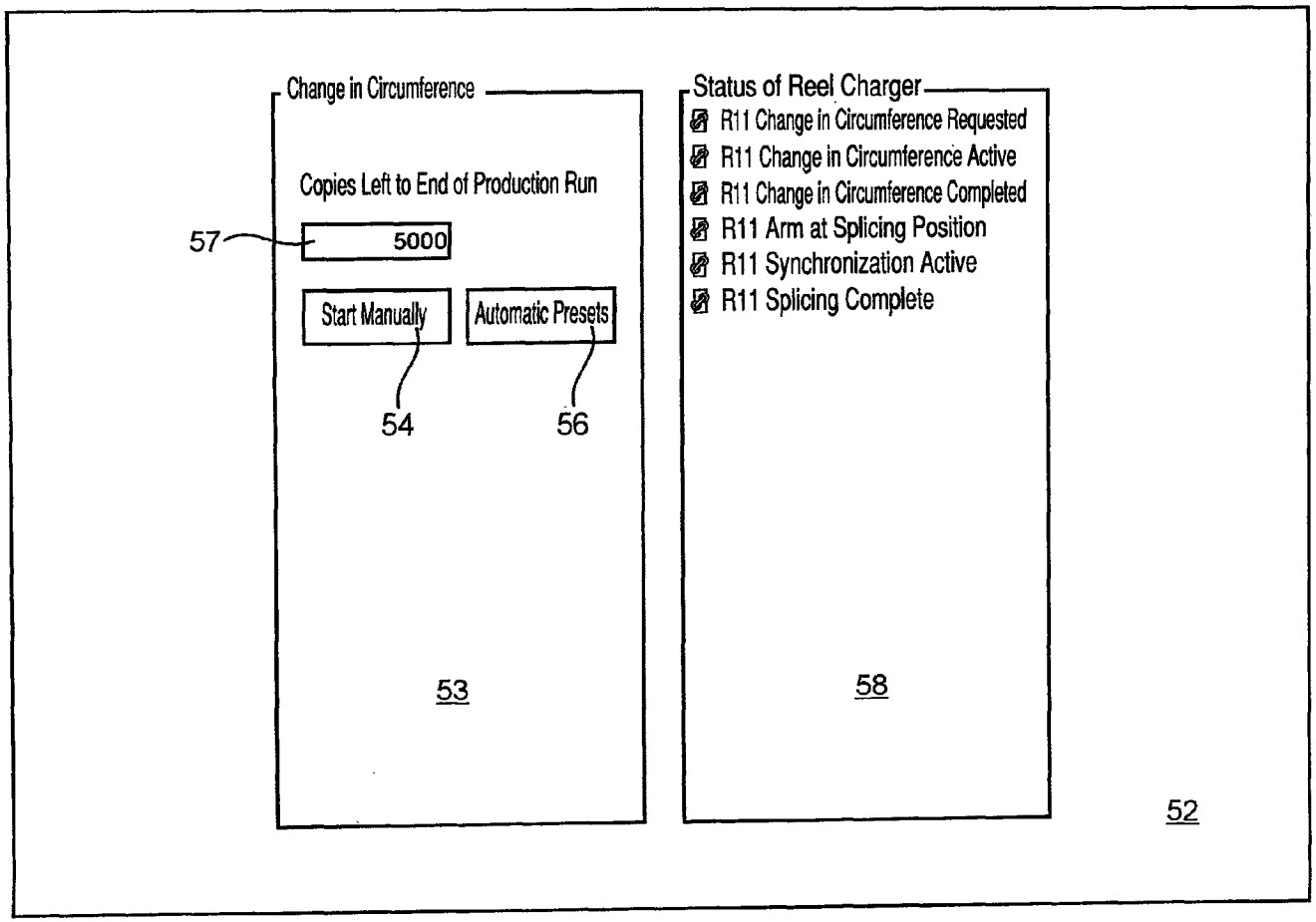
FIG. 17 a schematic illustration of a program screen on a display device of a control panel.

FIG. 17 shows, by way of example, a program screen 52, or screen 52, which can be displayed, for example, on the display device of one, or at least one of optionally multiple control panels of the printing press. This program screen 52 is generated or is a component of a software program which controls the execution of the process for resetting the web-fed printing press from an ongoing production of a first printed product to a subsequent production of a second printed product, wherein the webs of material are different from one another, for example, in terms of their respective widths and/or the type and/or base weight of their material, i.e., the change in circumference is carried out automatically or optionally (partially) manually. The program screen 52 has, for example, a control field 53, in which, for example, by actuating a corresponding button 54 or 56, it can be established whether the method for resetting the web-fed printing press from an ongoing production of a first printed product to a subsequent production of a second printing product is to be controlled by an operator (partially) manually (i.e., for example, by initiation in steps) or automatically, solely program controlled. In the case of an automatic execution of this process, as illustrated by way of example in FIG. 17, in one input field 57 a number of copies that remain of the first printed product is entered and therefore defined as a starting value, e.g., 5,000 copies, as shown. When, in the ongoing production run, only this number of copies of the first printed product remains to be produced, the program, which is preferably implemented in a control panel, will initiate the execution of this process for resetting the web-fed printing press from an ongoing production of a first printed product to a subsequent production of a second printed product. Arriving at the residual number of copies of the first printed product, which can be variably entered and is actually entered into input field 57, defines the point in time at which the control unit of the printing press 01 will begin to reduce the production speed of the printing press. The program screen 52 further has, for example, at least one display field 58, in which at least an operational status of various units of the web-fed printing press which are involved in the execution of this process for resetting the web-fed printing press from an ongoing production of a first printed product to a subsequent production of a second printed product is preferably displayed. In the example illustrated in FIG. 17, the displayed operational data relate to sequential operational states of at least one reel changer 01 involved in the process, wherein the displays in the display field 58, for example, are updated based upon events. In the case of a fully automatic change in circumference, the removal of the reel from storage and the transport of the reel 03 that is required for the subsequent production run, and which is different from the reel 03 previously loaded on the reel changer 01, to the transfer point 12 is carried out, for example, fully automatically, e.g., by means of driverless, automated systems (e.g., DTS, AGV, system-controlled, rail-mounted reel carts or combinations thereof), wherein the transfer of the new reel 03 to the inner loading loop then is also carried out automatically and independently by means of the control system.

Figure 18:
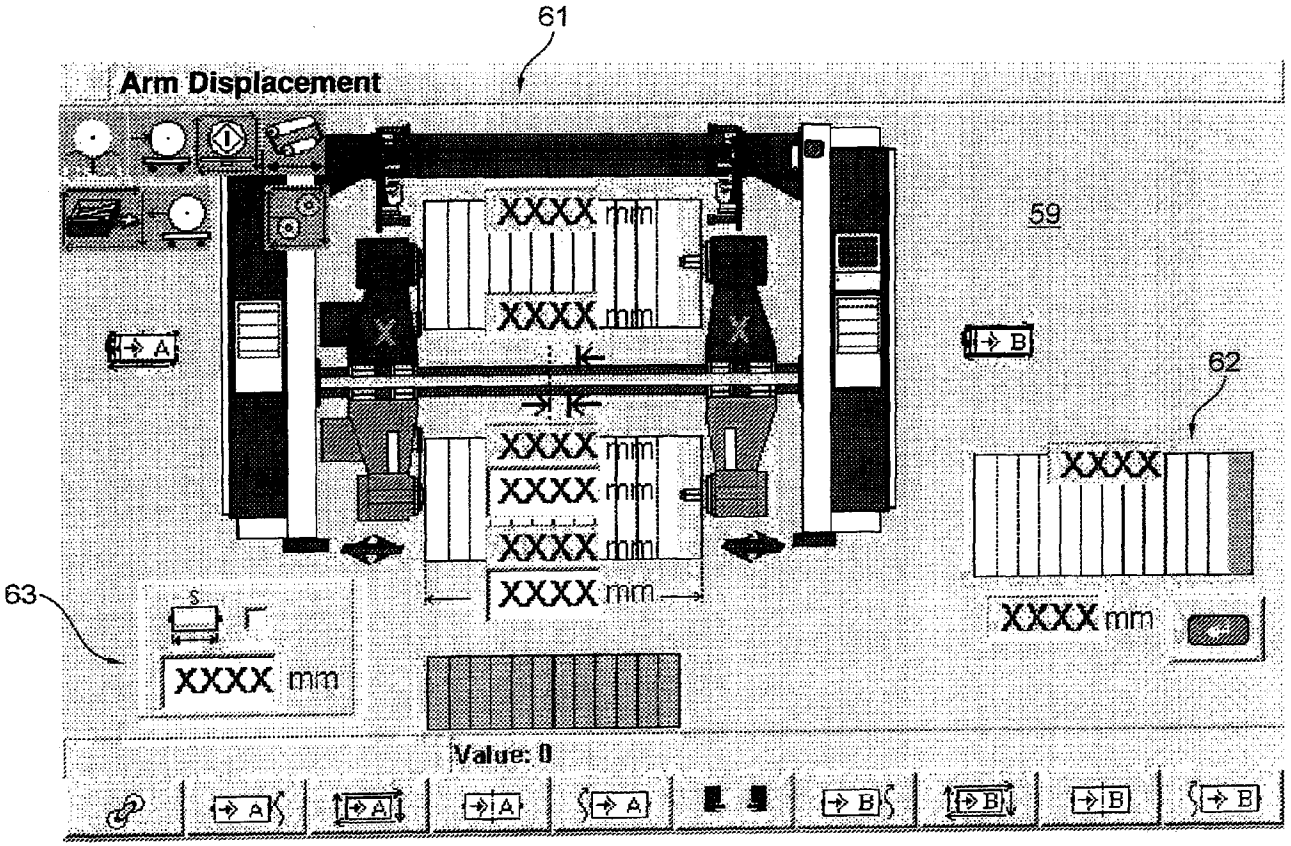
FIG. 18 a schematic illustration of a display in a screen relating to the reel changer status with respect to the reels and support arms.

In an operating mode or embodiment in which the change in circumference is carried out manually or semiautomatically, the new reel 03 can be transported to the transfer point 12 automatically or under manual control. However, a transfer and/or a transport into the secured area 17, i.e., the initiation or continuation of the change in circumference process, requires at least one signal to be triggered by an operator. This serves to ensure, for example, verification by the operator that a reel 03 of the required type is actually present and/or that the proper splice preparation has been provided and/or that the reel changer 01 and/or the relevant support arms 02 for receiving the new reel 03 are located in the proper position for receiving said reel. A verification and/or correction or adjustment of the reel arms 02 can preferably be carried out by means of a program screen 59, or screen 59, that can be displayed on the control element 18 and controlled by the implemented software, for which FIG. 18 shows an embodiment example. In the screen 59, for example, a diagram 61 of the relevant reel changer 01 with its two pairs of support arms and with reels 03 loaded or to be loaded is schematically illustrated, wherein, for example, for each reel 03 or pair of support arms, the width of the reel 03, the position thereof relative to the center axis of the machine, and/or the distance between the support arms or the relative position thereof is displayed for the activated pair of support arms. Input fields 62; 63 can be activated, for example, by selecting the relevant reel 03 or the relevant pair of support arms, in order, for example, to enter, or to be able to enter, changes or preset parameters for reel width and/or relative lateral position into input field 62, and changes or preset parameters for the distance between support arms or the relative position thereof into input field 63, via the input means of control element 18.

Figure 9:
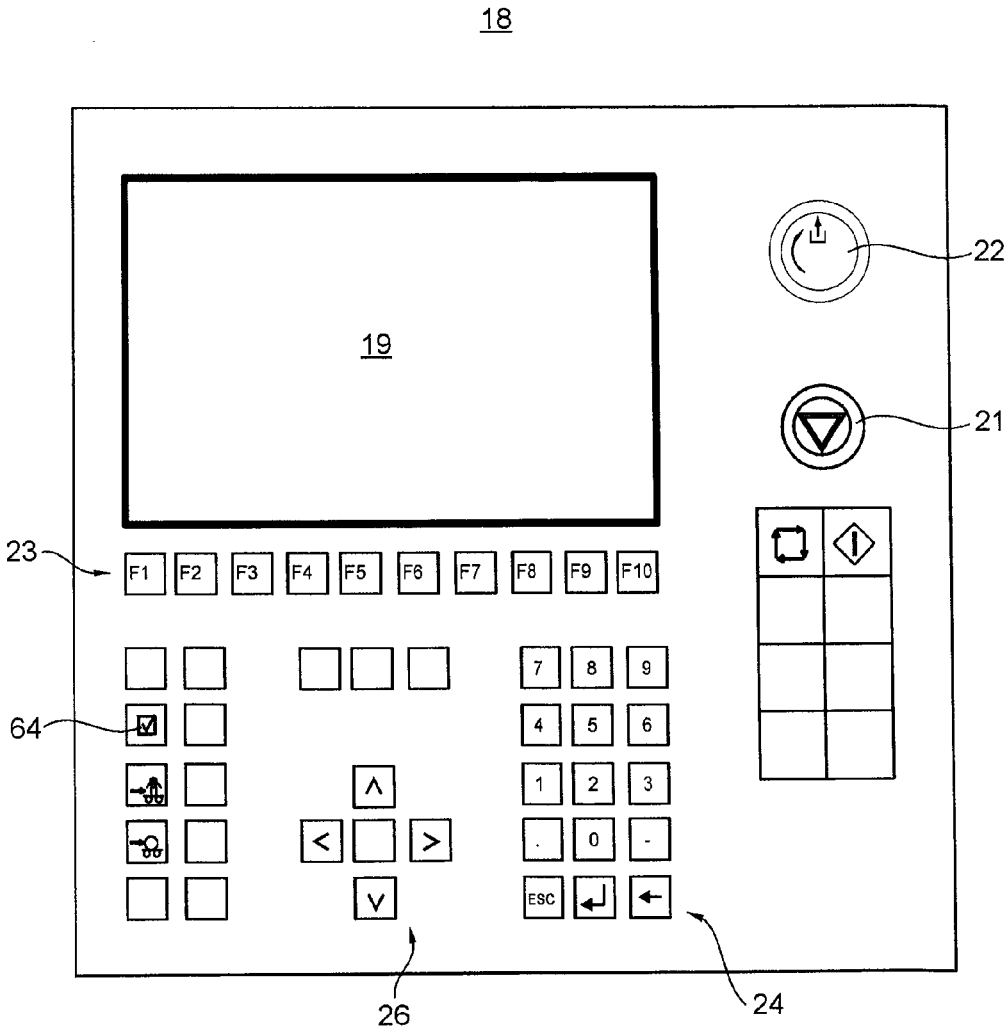
FIG. 9 a schematic illustration of an embodiment example of the control element.
Figure 10:
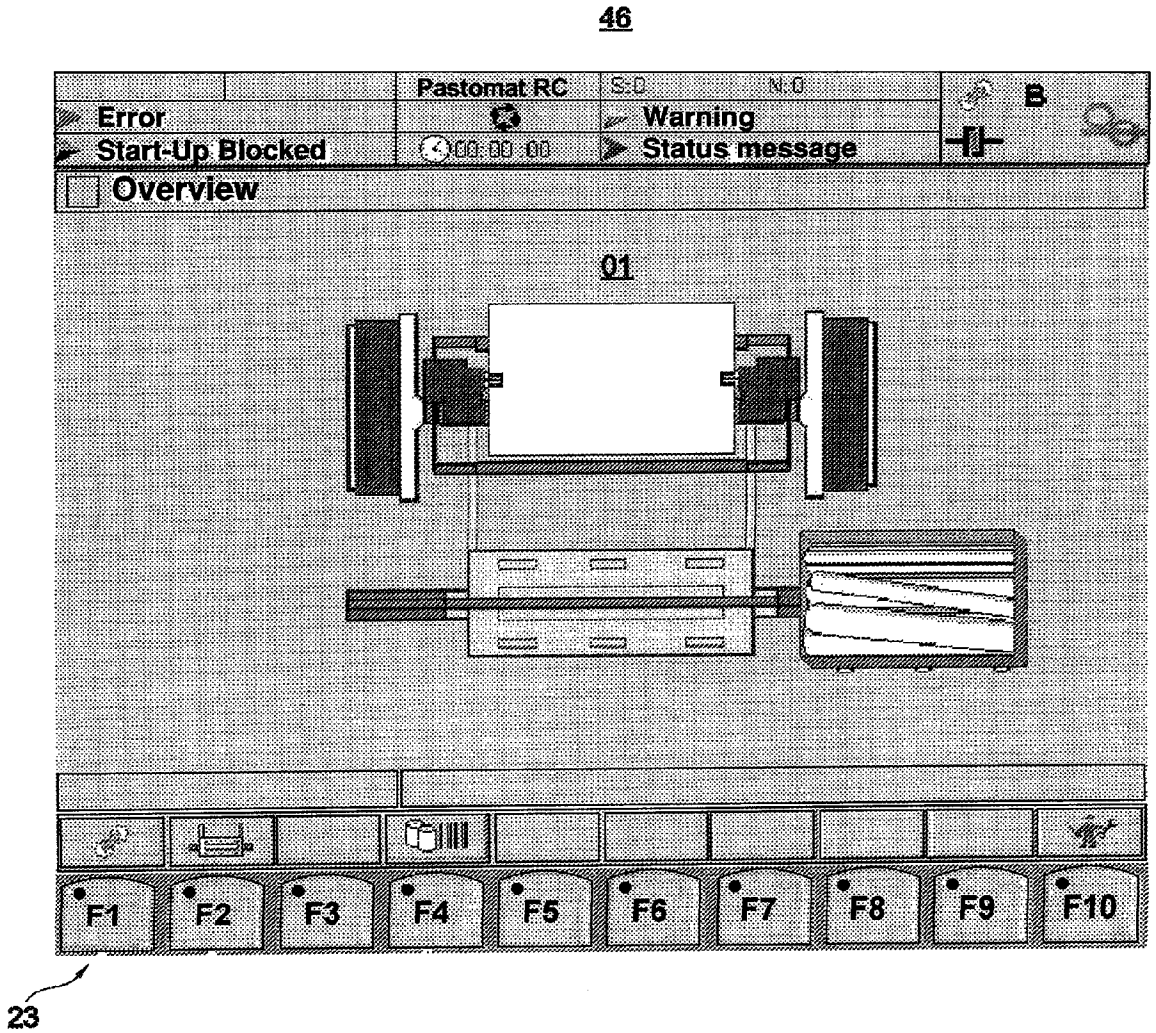
FIG. 10 a schematic illustration of a display in overview mode.

In the case of an only partially automatic or manual execution or operating mode with the above-mentioned change in circumference, the control element 18 preferably has a switching and/or input means 64, by means of which the operator can introduce the abovementioned signal for initiating and/or continuing the change in circumference process. In addition, the switching and/or input means 64, as illustrated by way of example in FIG. 9, can be configured as a switching element embodied as mechanical or touch-sensitive. However, it can also be embodied as a virtual switching element in a screen displayed on the display 19, which can be selected and confirmed by the operator via control means provided on the control element (e.g., cursor controller and Enter key).

The presented embodiments of the control element 18 can be advantageous alone, but in their embodiment are advantageous together with the "placement" of said control element "outside of the area" and/or in combination with the expanded secured area 17 and/or in combination with the safety device. The multifunctional control element 18 configured in this manner is particularly advantageously provided with the expanded secured area or the outside arrangement, because it allows a person skilled in the art comprehensive control, even at a distance from the reel changer 01 or the secured area 17 thereof. The latter, for example also in combination with the initiation of a change in circumference, if—as in the advantageous embodiment—the control element 18 comprises an above-described switching and/or input means 64 and is connected by means of signals to a control circuit in an active signals connection such that an introduction and/or continuation and/or completion of loading of the reel changer 01 for at least the case of a change in reel width and/or base weight and/or print substrate color (a change in circumference as described above), is dependent upon the switching status to be implemented via the switching and/or input means 64, i.e., upon a confirmation of the process by the operator.

While preferred embodiments of a reel changer having a device for protecting a secured area, in accordance with the present invention, have been set forth fully and completely hereinabove, it will be apparent to one of skill in the art that various changes in, for example, the specific structure of the printing press and of the reel changer and the like could be made without departing from the true spirit and scope of the present invention which is accordingly to be limited only by the appended claims.

What is claimed is:

1. A reel changer of a printing press comprising:

at least first and second spaced end face side frames which comprise vertical supporting frame parts for the reel changer of the printing press and which side frames are spaced apart across a width of the reel changer and are adapted to be able to support any ones of switchboxes and side boxes which may be arranged directly on the frame parts;

a secured area which extends at least on one of a receiving side and a discharge side of the reel changer and which has a width at least across the first and second end face side frames, the secured area being substantially enclosed, on one side, by the reel changer and on other sides by at least one of adjacent units and mechanical blocking devices, the secured area including a receiving and discharge area of the reel changer and an inner loading of the reel changer;

a device for protecting the secured area;

at least one sensor-monitored access point to the secured area and located in one of the other sides, the at least one sensor-monitored access point being adapted to afford an operational entry into the secured area by operators of the reel changer and through which operators of the reel changer can enter into the secured area only by moving through the at least one access point; and a control element usable to control functions of the reel changer, the control element being separated from the an ones of switchboxes and side boxes which may be arranged directly on the frame parts, the control element being positioned structurally separated from the reel changer and spaced from the side frames of the reel changer at a location which can be reached by an operator located outside of the secured area.

2. The reel changer of a printing press according to claim 1 wherein the control element is embodied as a control panel, which comprises at least one of functions for controlling the reel changer itself and for controlling an inner loading loop and with functions for requesting reels from one of a warehouse and a storage area.

3. The reel changer of a printing press according to claim 1 wherein the control element is one of assigned to a specific reel changer and arranged operationally stationary, and mechanically detachable, at the location that is spaced from the reel changer.

4. The reel changer of a printing press according to claim 1 wherein the secured area extends across a width that is greater than a distance between the exterior sides of the end face side frames.

5. The reel changer of a printing press according to claim 1 wherein, on a loading side of the reel changer, one of the mechanical blocking devices and the at least one sensor-monitored access point are arranged spaced from the side frame in such a way that the width of the secured area extends, at least on this loading side at least across a frame outer alignment which extends on an exterior side of the side frame on the loading side perpendicular to an axis of the reel changer.

6. The reel changer of a printing press according to claim 1 wherein the secured area which is located on at least one of the receiving and discharge side of the reel changer extends, on a loading side of the reel changer, up to a frame outer alignment which extends on an exterior side of the side frame on the loading side perpendicular to an axis of the reel changer, and also from the reel changer further outward, beyond an alignment of the exterior frame side, and further wherein one sensor-monitored access point is provided on a loading side of the reel changer and is arranged on a side of a frame outer alignment that is distant from the reel changer, and which is spaced laterally therefrom.

7. The reel changer of a printing press according to claim 1 wherein the sensor-monitored access point has a safety device including at least one sensor system having at least one transmitter and at least one receiver for one of electromechanical radiation and acoustic waves, and having an evaluation device for logic-based signals processing, such that a prohibited interruption of at least one of a beam emitted by the transmitter and to be picked up by the at least one receiver for the one of electromechanical radiation and acoustic waves and an acoustic wave transmitted by the transmitter and to be picked up by the at least one receiver for the at least one of electromechanical radiation and acoustic waves triggers a signal change at the output of the sensor system, and further wherein the evaluation unit has one of circuitry and computing means such that, as a result of the signal change, one of an alarm can be triggered and a movement of support arms can be halted and a movement of a reel to be transported can be halted.

8. The reel changer of a printing press according to claim 7 wherein the sensor system includes at least one light beam which is usable for monitoring purposes and which projects across a width of the at least one sensor-monitored access point above a height of a reel passing through the at least one sensor-monitored access point, and further wherein the beam extends tilted at least one of 15° from vertical and at least 15° from horizontal.

9. The reel changer of a printing press according to claim 7 wherein the sensor system includes at least one light beam, which at least one light beam extends at least substantially horizontally, projects across a width of the at least one sensor-monitored access point, and at a height of a reel passing through the at least one sensor-monitored access point.

10. The reel changer of a printing press according to claim 9, wherein the light beam is a part of a light barrier comprising a group of multiple light beams each extending substantially horizontally and parallel to one another.

11. The reel changer of a printing press according to claim 10 wherein a plane formed by a plurality of the light beams of the light barrier is arranged tilted in relation to a vertical plane (S) that extends along the boundary of the sensor-monitored access point to be secured.

12. The reel changer of a printing press according to claim 7 wherein the sensor system includes a device for one of implementing deactivation and partial deactivation, such that, when an object is identified, during one of passage and prior to passage through the at least one sensor-monitored access point, as "allowed", a protective function of at least a part of the sensor system that interacts with the object is deactivated at least temporarily with respect to a reaction to the entry of the identified "as allowed" object.

13. The reel changer of a printing press according to claim 7 including a device for implementing one of deactivation and partial deactivation and which includes at least one of an evaluation routine that analyzes a sequence of interruptions of the sensor system, and a device that interacts with the approaching object before it reaches the sensor system for the detection of the object.

14. The reel changer of a printing press according to claim 1 wherein, on one of the receiving and discharge side of the reel changer, a transport path is provided for the transport of reels to be one of received and discharged by the reel changer, which transport path extends parallel to the reel changer axis and parallel to an axis of a reel that is received, in a loading state, on the reel changer.

15. The reel changer of a printing press of claim 1 further including a frame outer alignment which continues an exterior side of the side frame on the loading side perpendicular to an axis of the reel changer, the secured area extending, on the loading side of the reel changer, beyond the frame outer alignment, the sensor-monitored access point provided on the loading side being arranged on the frame outer alignment which is distant from the reel changer and spaced laterally therefrom.

16. The reel changer of a printing press of claim 1 further including at least one of a control system and a sensor system of the reel changer and an inner loading loop and wherein the control element is connected to the at least one of the control system, sensor system and inner loading loop.

17. The reel changer of a printing press of claim 1 wherein the control element includes one of a switching and an input means which is connected to a control circuit whereby one of an introduction, continuation and completion of loading the reel changer for at least one of a change in reel width, base weight and print substrate color is dependent on a switching status implemented by the one of the switching and input means upon confirmation by the operators of the reel changer.

18. A reel changer of a printing press comprising:

at least first and second spaced end face side frames which comprise vertical supporting frame parts for the reel changer of the printing press and which side frames are spaced apart across a width of the reel changer and which are adapted to be able to support any ones of switchboxes and side boxes which may be arranged directly on the frame parts;

a secured area which extends at least on one of a receiving and a discharge side of the reel changer and which has a width at least across the first and second end face side frames, the secured area being substantially fully enclosed, on one side, by the reel changer and on other sides by at least one of adjacent units and mechanical blocking devices, the secured area including a receiving and discharge area of the reel changer and an inner loading loop of the reel changer;

a device for protecting the secured area;

at least one sensor-monitored access point to the secured area and located in one of the other sides, the at least one sensor-monitored access point being adapted to afford an operational entry through the secured area by operators of the reel changer and into which operators of the reel changer can enter into the secured area only by moving through the at least one access point; and a frame outer alignment which continues an exterior side of the side frame on the loading side perpendicular to an axis of the reel changer, the secured area extending, on the loading side of the reel changer, beyond the frame outer alignment, the sensor-monitored access point into the secured area and which is provided on the loading side being arranged on the frame outer alignment which is distant from the reel changer and spaced laterally therefrom.

19. The reel changer of a printing press according to claim 18 wherein a width of the secured area, at least in an area of an alignment along the transport path, extends beyond the frame outer alignment.

* * * * *

UNITED STATES PATENT AND TRADEMARK OFFICE

CERTIFICATE OF CORRECTION

PATENT NO. : 8,757,534 B2
APPLICATION NO. : 13/522383
DATED : June 24, 2014
INVENTOR(S) : Lehrieder et al.

It is certified that error appears in the above-identified patent and that said Letters Patent is hereby corrected as shown below:

In the Claims

Column 19, Claim 1, line 30, after “loading”, insert --loop--; and line 40, after “the” (second occurrence) change “an” to --any--.

Signed and Sealed this
Eleventh Day of November, 2014

Michelle K. Lee

Michelle K. Lee
*Deputy Director of the United States Patent and Trademark Office*